US006701102B2

(12) United States Patent
Hasegawa et al.

(10) Patent No.: US 6,701,102 B2
(45) Date of Patent: Mar. 2, 2004

(54) METHOD AND APPARATUS FOR CONTROLLING THE TEMPERATURE IN A FIXING DEVICE OF AN IMAGE FORMING APPARATUS

(75) Inventors: Hiroto Hasegawa, Shizuoka (JP); Toshio Miyamoto, Shizuoka (JP); Satoru Izawa, Shizuoka (JP); Masahiko Suzumi, Shizuoka (JP); Kenji Kanari, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 09/996,914

(22) Filed: Nov. 30, 2001

(65) Prior Publication Data

US 2002/0118977 A1 Aug. 29, 2002

(30) Foreign Application Priority Data

Dec. 1, 2000 (JP) ..... 2000-367271
Dec. 20, 2000 (JP) ..... 2000-387193

(51) Int. Cl.[7] ..... G03G 15/20
(52) U.S. Cl. ..... 399/69; 219/216; 399/330
(58) Field of Search ..... 399/67, 69, 70, 399/328, 330, 331; 219/216

(56) References Cited

U.S. PATENT DOCUMENTS

| | | | | |
|---|---|---|---|---|
| 5,083,168 A | | 1/1992 | Kusaka et al. | 355/285 |
| 5,148,226 A | | 9/1992 | Setoriyama et al. | 355/290 |
| 5,149,941 A | | 9/1992 | Hirabayashi et al. | 219/216 |
| 5,162,634 A | | 11/1992 | Kusaka et al. | 219/216 |
| 5,210,579 A | | 5/1993 | Setoriyama et al. | 355/285 |
| 5,262,834 A | | 11/1993 | Kusaka et al. | 355/285 |
| 5,300,997 A | | 4/1994 | Hirabayashi et al. | 355/285 |
| 5,343,280 A | | 8/1994 | Hirabayashi et al. | 355/285 |
| 5,517,284 A | * | 5/1996 | Ohtake et al. | 399/69 |
| 5,525,775 A | | 6/1996 | Setoriyama et al. | 219/219 |
| 5,767,484 A | | 6/1998 | Hirabayashi et al. | 219/216 |
| 5,903,799 A | * | 5/1999 | Saito et al. | 399/69 |
| 5,960,233 A | | 9/1999 | Goto et al. | 399/69 |
| 6,006,051 A | * | 12/1999 | Tomita et al. | 399/69 |
| 6,035,155 A | * | 3/2000 | Kaji et al. | 399/69 |
| 6,101,346 A | * | 8/2000 | Arakawa | 399/70 |
| 6,175,699 B1 | * | 1/2001 | Kato et al. | 399/69 |
| 6,243,547 B1 | * | 6/2001 | Mizuno et al. | 399/69 |

FOREIGN PATENT DOCUMENTS

| | | |
|---|---|---|
| JP | 63-313182 | 12/1988 |
| JP | 02-157878 | 6/1990 |
| JP | 04-044075 | 2/1992 |

(List continued on next page.)

*Primary Examiner*—Fred L. Braun
(74) *Attorney, Agent, or Firm*—Fitzpatrick, Cella, Harper & Scinto

(57) ABSTRACT

In a method and apparatus for controlling the temperature of a fixing device of the film heating type and the pressure rotary member driving type and an image forming apparatus provided with this fixing device, at the start of printing, the output of a thermistor near a heater is detected, and when the temperature difference ΔT=T2−T1 between the detected temperature T1 and the fixing temperature T2 is smaller than a desired temperature T0, the raising timing of the heater is delayed. Thereby, a pressure roller is not-excessively warmed at hot start and slip can be prevented. Also, in the image forming apparatus having the film heating type fixing device, in the next printing after the lapse of a predetermined time after the termination of a printing operation, the target temperature and heater electrical energization starting timing of the fixing device are changed in conformity with the temperature of the fixing device. The apparatus has an atmospheric temperature sensor, and in the next printing after the lapse of a predetermined time after the termination of a printing operation, the target temperature and heater electrical energization timing of the fixing device during the initial rotation operation in the printing, operation are changed in conformity with the atmospheric temperature detected by the atmospheric temperature sensor and the temperature of the fixing device.

20 Claims, 16 Drawing Sheets

FOREIGN PATENT DOCUMENTS

| | | | | |
|---|---|---|---|---|
| JP | 04-044076 | 2/1992 | | |
| JP | 04-044077 | 2/1992 | | |
| JP | 04-044078 | 2/1992 | | |
| JP | 04-044079 | 2/1992 | | |
| JP | 04-044080 | 2/1992 | | |
| JP | 04-044081 | 2/1992 | | |
| JP | 04-044082 | 2/1992 | | |
| JP | 04-044083 | 2/1992 | | |
| JP | 04-204980 | 7/1992 | | |
| JP | 04-204981 | 7/1992 | | |
| JP | 04-204982 | 7/1992 | | |
| JP | 04-204983 | 7/1992 | | |
| JP | 04-204984 | 7/1992 | | |
| JP | 10-288935 | * 10/1998 | ..... | G03G/15/20 |

* cited by examiner

CONTROLLED FIXING TEMPERATURE IN INTERMITTENT PRINTING (START AT FIRST EARLY IN THE MORNING)

METHOD AND APPARATUS FOR CONTROLLING THE TEMPERATURE IN A FIXING DEVICE OF AN IMAGE FORMING APPARATUS

BACKGROUND OF THE INVENTION

1. Field of the Invention

The invention relates to a fixing device for heating and fixing an unfixed image formed and borne on a recording material, and an image forming apparatus such as a printer, a copier or a facsimile apparatus using the fixing device. More particularly, the invention relates to a fixing device of the film heating type or the pressure rotary member driving type, and an image forming apparatus provided with the fixing device. The fixing device of the film heating type will hereinafter be sometimes referred to as a film type fixing device.

2. Description of Related Art

In image forming apparatuses such as a printer, a copier and a facsimile apparatus using the image forming technique such as the electrophotographic process or the electrostatic recording process, heat roller fixing devices of the contact heating type good in heat efficiency and safety and energy saving type and on-demand type fixing devices of the film heating type have heretofore been widely adopted as fixing devices for fixing an unfixed image formed and borne on a recording material.

A fixing device of the film heating type is proposed, for example, in Japanese Patent Application Laid-Open No. 63-313182, Japanese Patent Application Laid-Open No. 2-157878, Japanese Patent Application Laid-Open Nos. 4-44075 to 44083, Japanese Patent Applications Laid-Open Nos. 4-204980 to 204984, etc., and is a device having a heater (heating member), heat-resistant film (fixing film) frictionally sliding relative to this heater, and a pressure member being in pressure contact with the heater with the film interposed therebetween and forming a fixing nip portion, and in which a recording material having an unfixed image formed thereon is nipped and conveyed between the film and the pressure member in the fixing nip portion, whereby the unfixed image on the recording material is a fixed as a permanent image by heat imparted from the heater through the film and the pressure force of the fixing nip portion.

Such a fixing device of the film heating type can use a low heat capacity linear heating member as the heater, and use thin film of low heat capacity as the film and therefore, the saving of electric power and the shortening of waiting time (the quick starting property) are possible.

Also, in the fixing device of this film heating type, as driving systems for the fixing film, there are a system using a conveying roller and a driven roller exclusively for the conveyance of the film and conveying the fixing film between the conveying roller and a pressure roller as the pressure member while applying tension, and a tensionless system for rotatively driving the pressure roller as the pressure member to thereby drive cylindrical fixing film by the conveying force of the pressure roller. The former has the advantage that the conveying property of the fixing film can be heightened, and the latter has the advantage that the construction of the device can be simplified to thereby realize a low-cost device. In recent years, the latter rotary member driving system for pressurization has often been adopted because of the small number of parts required in it.

Also, with the recent development of the computer industry, the demand for printers has been on the rise and printers have come to be used in various countries of the world. Thus, recording materials used are rich in the variety of type, thickness, surface property, etc. and at the same, coupled with the higher speed of the image forming apparatus, the instantaneous quantity of heat given from the heater to the recording material has been increased little by little to thereby obtain a satisfactory fixing property from the viewpoints of the shortening of the printing time for the first sheet, the securement of the fixing property of the first printed sheet, etc. Further, in recent years, the user's requirement for a high quality of image has increased and printers excellent in dot reproducibility and halftone reproducibility have been announced, and the particle diameter of a toner which is a visualizing agent (developer) has been made smaller, whereby a higher image of quality has been achieved.

When use was made of developing devices of the film heating type and the pressure rotary member driving type and 50 sheets were passed in intermittent printing, "slip jam" occurred in the fixing devices.

The slip jam (hereinafter referred to as the slip) is a phenomenon which is caused by the pressure roller and a recording material (hereinafter referred to as the paper sheet) bearing an unfixed image thereon slip relative to each other when in a fixing device of the film heating type and the pressure rotary member driving type which is pressure roller driving and film driven (tensionless), the paper sheet has been conveyed to the fixing nip portion.

The result of the measurement of the rotational speed of the film effected by a laser Doppler speed meter in a state in which the slip occurred is shown in FIG. 14 of the accompanying drawings. As shown in FIG. 14, it will be seen that from the moment when the paper has been nipped by the fixing nip portion, the paper slips, whereby the speed of the film becomes lower and the driving force from the pressure roller is not transmitted to the film. Therefore, the paper sheet cannot be conveyed at a constant speed and the slip occurs.

Further, when the confirmation of the slip has been made, it has been found that the slip is liable to occur under the following conditions.

Condition (i): the moisture absorbing amount of the recording material (paper sheet) is high.

Condition (ii): the temperature of the pressure roller is high.

Condition (iii): the dot percentage of the print pattern is high.

About Condition (i)

Media various in texture, basis weight, etc. are used for printing. Among these, there are media which absorb moisture when they are left under a high-temperature high-humidity environment. Therefore, when in the course of printing, the paper is conveyed to the fixing nip, the pressure roller and the film are sufficiently warmed by the heating of the heater, and when the paper sheet is nipped by the fixing nip, steam is created from the paper. The steam created at this time is present between the pressure roller and the paper sheet and therefore, the conveying force of the pressure roller is not transmitted to the film through the paper and the film slips.

The heater is heating also during the time when the film slips, and by time elapsing after the slip has occurred, the steam contained in the paper evaporates, and when the driving force from the pressure roller comes to be transmitted to the film through the paper sheet, the paper conveying speed comes to be obtained stably (FIG. 14). However, by the slip occurring at first, paper conveyance is delayed to thereby cause jam.

Generally, as paper liable to cause slip, mention may be made of paper having the moisture content of 8.0% or greater when left under 23° C. and 70% RH, and 70 g/m$^2$ or less as the basis weight.

About Condition (ii)

The fixing temperature during printing (target temperature) is determined so that the fixing property can be secured and heat offset may not occur. Further, the fixing temperature (target temperature) is determined in conformity with the temperature detected by a thermistor immediately before printing is started, and is controlled so as to become a high heater temperature in a state in which the fixing device has been cooled as when a power source switch has been closed, and further, when printing is continued, the pressure roller, a film guide, a rigid pressure stay (a T-stay or a metallic stay), etc. are warmed and therefore, it is a usual practice to lower the fixing temperature in conformity with the number of printed sheets.

When intermittent printing is effected, the pressure roller is heated by the remaining heat in each printing course and the heat thereof is accumulated therein and therefore, the temperature tends to become high as compared with that in continuous printing.

Also, the heater ON timing in the fixing process is generally such that the printer receives a printing signal so that fixing device constituting parts such as the pressure roller and the fixing film may sufficiently warm before the paper enters the fixing device at the start of printing, and the heater is turned on when the printing process starts.

At this time, it is usually the case that the heater is turned on after the switched-ON of a sheet feed sensor during the sheet feeding at the start of printing or after the switched-ON of a top sensor or a registration sensor before the paper enters the fixing nip.

In the case of intermittent printing in which the stop interval is short, as compared with continuous printing, the temperature of the pressure roller becomes excessively high (it will hereinafter be called the hot start to start printing in a state in which the pressure roller is warming), and by a temperature of about 150° C. or higher being reached for the printing of about 50 sheets, the slip occurs.

About Condition (iii)

The slip is liable to occur in the case of printing patterns high in dot percentage. As image patterns high in dot percentage, mention may be made of a solid black image and a graphic pattern such as a halftone, and these patterns are such that a toner image is formed on the entire area of the printing surface of the paper. Therefore, during the occurrence of the slip, the steam created from the paper cannot escape because of the presence of the toner image on the printing surface and thus, positively escapes to the back side of the paper, i.e., the pressure roller side. Consequently, the slip is liable to occur due to the steam collecting between the pressure roller and the paper.

Also, the film type fixing device has suffered from the following problems.

In an image forming apparatus using the film type fixing device, the quantity of heat is liable to become deficient or excessively great depending on the environmental temperature at which the image forming apparatus is used because the heat capacity of the fixing device is small as previously described. In the film type fixing device, the quantity of heat to be given from the heater to a recording material (hereinafter referred to as the paper sheet) differs considerably depending on the temperature of the pressure roller which is a pressure member. Accordingly, the controlled temperature of the heater is suitably changed so that depending on the number of printed sheets and the time elapsed after the preceding fixing process has been terminated, a quantity of heat conforming to the temperature of the pressure roller may be given from the heater to the paper sheet so that the quantity of heat given from the heater and the pressure roller to the paper sheet may always be constant.

Specifically, in the case of continuous printing from when the fixing device after the switched-ON of a power source is cold, the temperature of the pressure roller is low and therefore the controlled temperature is set to a high level, and when the number of printed sheets is increased and the temperature of the pressure roller becomes high, a quantity of heat is also supplied from the pressure roller to the paper sheet and therefore, the controlled temperature is set so as to be gradually lowered.

When the continuous printing is terminated and the standby state is once restored, it is necessary to determine the next controlled temperature (target temperature) at a point of time whereat the next printing signal has come. If the set controlled temperature is too high, a portion of an image will remain on the fixing film side due to the excessively great quantity of heat and there will arise the problem of offset which will cause a bad image after one round of the film, and the problem of fixing slip in which the conveyance of the paper is hampered by steam created from the paper in the fixing nip portion. On the other hand, if the set fixing temperature is too low, bad fixing or the contamination of the pressure roller in which the toner offset to the film during fixing collects on the pressure roller may occur.

Usually, at the start of printing, the temperature of the temperature control thermistor of the fixing device is monitored as the temperature of the fixing device and the set controlled temperature is determined, but when the fixing device is still warm immediately after the printing operation, the determined temperature has a factor which becomes an error to the optimum temperature. That is, after a small amount of printing, the lowering of the temperature of the fixing device is sudden, but after a large amount of printing, the whole of the fixing device is sufficiently warm and therefore, the fall of the temperature is gentle. For example, if the controlled temperature of the thermistor of the fixing device is monitored to thereby determine the controlled temperature when the next print signal has come immediately after the termination of a small amount of printing, a high temperature is detected and thus, lower temperature control setting is selected. Actually, however, only a small amount has been printed and the fixing device is not yet sufficiently warmed and therefore becomes cold immediately after the determination of the controlled temperature, and may become deficient in quantity of heat and bad fixing may occur when the fixing operation for the next print is performed.

Due to such an error factor, a wrong controlled temperature may be selected and the problems as noted above may arise.

Also, the film type fixing device is small in heat capacity and therefore is also liable to be affected by the ambient temperature of the image forming apparatus. For example, if the atmospheric temperature of the image forming apparatus is low, the temperature of the paper, the toner, etc. also become low and therefore, the bad fixing and thee contamination of the pressure roller by the deficient quantity of heat are liable to occur. On the other hand, if the atmospheric temperature is high, the hot offset and the slip of the fixing device by an excessively great quantity of heat may be liable to occur.

When the film type fixing device is adopted in a medium or high speed apparatus, the fixing device passing time tends to become shorter correspondingly to the fact that the process speed becomes higher, and to become liable to be affected by the ambient temperature of the image forming apparatus. Also, the setting of the temperature control becomes high in order to secure the fixing property, and bad fixing and hot offset will occur unless an appropriate controlled temperature is adopted.

SUMMARY OF THE INVENTION

It is an object of the present invention to solve the above-noted problems.

It is another object of the present invention to prevent the above-described slip during intermittent printing and hot start in a fixing device of the film heating type and the pressure rotary member driving type and an image forming apparatus provided with the fixing device.

It is another object of the present invention to solve the above-noted problems in an image forming apparatus using a film type fixing device as a fixing device for fixing an unfixed image formed and borne on a recording material, that is, to achieve the optimization of the fixing control temperature in the hot started state of the fixing device, and to prevent the slip and hot offset of the fixing device.

In order to achieve the above objects, the fixing device and the image forming apparatus according to the present invention are as follows:

(1) A fixing device comprising a fixedly supported heater, film sliding relative to the heater, and a pressure rotary member brought into pressure contact with the heater with the film interposed therebetween and forming a fixing nip, and rotatively driven, and wherein a recording material having an unfixed image formed thereon is nipped and conveyed between the film and the pressure rotary member at the fixing nip to thereby fix the unfixed image by the heat of the heater, further having temperature control means for changing over the heating time of the heater when the temperature difference between the detected temperature by a temperature detecting element for detecting the temperature of the heater and the target heating temperature of the heater is smaller than a desired value.

More specifically, when at the start of printing, the temperature difference between the detected temperature by the temperature detecting element and the target heating temperature of the heater is A° C. or less, control is effected such that the ON timing of the heater is delayed more than when the temperature difference is greater than A° C.

That is, when the detected temperature by the temperature detecting element for detecting the temperature of the heater is defined as T1 and the target heating temperature of the heater is defined as T2, when $T1-T2 \leqq A$, the ON timing of the heater is delayed more than when $T1-T2>A$.

By the above-described construction, when intermittent printing has continued and the pressure roller has been sufficiently warmed by the remaining heat during the printing, $T1-T2 \leqq A$ is brought about at the start of the next printing, and raising is effected with the ON timing of the heater delayed more than when $T1-T2>A$. Thus, the pressure roller is not excessively warmed at the starting of the heater, and even if a recording material (paper sheet) having absorbed moisture is nipped by the fixing nip, the steam created between the pressure roller which is a pressure rotary member and the paper is of a small amount, and even if the paper contacts with the pressure roller, it will not slip. Consequently, even in intermittent printing, the driving force of the pressure roller can be stably transmitted to the film through the paper sheet, and it becomes possible to prevent slip and stabilize the conveyance of the paper sheet.

Also, even if the ON timing of the heater is delayed, it becomes possible to raise the heater to the target heater temperature within a short time because the pressure roller, the film guide, etc. are sufficiently warm, and a temperature necessary for fixing can be sufficiently secured and bad fixing does not occur.

(2) The fixing device described in item (1) above, wherein the heating time of the heater is changed over a plurality of times in conformity with the temperature difference between the detected temperature by the temperature detecting element for detecting the temperature of the heater and the target heating temperature of the heater.

More specifically, control is effected such that when the temperature difference is A, B, and C [° C.], and A>B>C, the ON timing of the heater is started late in the order of A, B, and C. By the above-described construction, the fixing temperature at the start of printing is Ta<Tb<Tc [° C.], and even when Tc is used to secure the fixing property for thick paper or the like, the ON timing of the beater can be made later than Ta and Tb. Consequently, even when the temperature of the heater is made high and intermittent printing is continued by the use of thick paper or the like, the pressure roller is not excessively warmed and it becomes possible to suppress the amount of steam created from the paper at the fixing nip to thereby prevent slip and stabilize the conveyance of the paper. At the same time, the fixing temperature is also high for the thick paper and therefore, a sufficient fixing property can be secured.

(3) The fixing device described in item (1) above, having an atmospheric temperature detecting element and wherein the heating time and the target heating temperature of the heater are changed over a plurality of times in conformity with the detected temperature by the atmospheric temperature detecting element and the temperature difference between the detected temperature by the temperature detecting element for detecting the temperature of the heater and the target heating temperature of the heater.

More specifically, temperature control is effected such that when the detected atmospheric temperature is $T\alpha$, $T\beta$ and $T\gamma$ ($T\alpha<T\beta<T\gamma$), the ON timing of the heater is made later in the order of $T\alpha$, $T\beta$ and $T\gamma$. By the above-described construction, $T\alpha$ can be judged to be a low-temperature environment, $T\beta$ can be judged to be an ordinary environment, and $T\gamma$ can be judged to be a high-temperature environment, and the amount of steam created from the paper at the fixing nip is greater in the order of $T\alpha$, $T\beta$ and $T\gamma$. So, by making the ON timing of the heater later in the order of $T\alpha$, $T\beta$ and $T\gamma$, the pressure roller is not excessively warmed in each environment and it is possible to suppress the amount of created steam to thereby prevent the slip. In addition, in the low-temperature environment, the paper is cold and therefore the quantity of heat required for fixing becomes great and the fixing temperature becomes high and thus, much time is taken for raising, but the heater is also raised early and therefore, the time for raising is sufficient and the fixing property can be secured.

(4) An image forming apparatus having image forming process means for forming an unfixed image on a recording material, and a fixing device for heating and fixing the unfixed image on the recording material, wherein the fixing device is the fixing device described in any of items (1) to (3) above.

(5) The image forming apparatus described in item (4) above, wherein the image forming process means is transfer type electrophotographic process means.

According to the present invention, in a fixing device of the film heating type or the pressure rotary member driving type and an image forming apparatus provided with the fixing device, when the temperature difference between the temperature of the vicinity of the heater detected before printing and the fixing target temperature is smaller than a desired value, the raising timing of the heater is made late, whereby the slip caused by the pressure roller being excessively warmed during intermittent printing can be prevented.

Also, by the raising timing of the heater being changed in conformity with the temperature difference, it becomes possible to prevent the slip irrespective of the fixing temperature for thick paper or the like, and also secure the fixing property.

Good fixed images can be obtained irrespective of the environment, the sheet type and the situation in which the paper is left, and also it becomes possible to prevent the slip and stabilize the conveyance of the fixed paper.

Further, by disposing an atmospheric temperature sensor (environment detecting sensor) in the image forming apparatus, optimum fixing temperature control conforming to the environment of use can be realized, and good fixed images can be obtained irrespective of the environment, the sheet type and the situation in which the paper is left, and also the slip can be prevented and the stabilization of the conveyance of the fixed paper can be realized.

An image forming apparatus using another film type fixing device according to the present invention is as follows:

(1) An image forming apparatus having a fixing device having a heater, film sliding relative to the heater, and a pressure member brought into pressure contact with the heater with the film interposed therebetween to thereby form a fixing nip, and wherein a recording material having an unfixed image formed thereon is nipped and convoyed between the film and the pressure member at the fixing nip to thereby fix the unfixed image by the heat of the heater, and in the next printing after the lapse of a predetermined time after the termination of any printing operation, the target temperature of the fixing device during the initial rotation in the printing operation and the heater electrical energization timing are changed in conformity with the temperature of the fixing device.

That is, in the printing in the state after the termination of any printing operation in which the fixing device is warm, the target temperature (ready temperature) during the initial rotation in the printing operation and the heater electrical energization timing are changed in conformity with the temperature of the fixing device after the lapse of a predetermined time, and specifically the temperature of the heater.

If immediately after the termination of printing, the fall of the temperature of the fixing device is sudden and therefore, the determination of the controlled temperature for the next printing is liable to have an error, but when a predetermined time (the order of several tens of seconds to one minute) elapses, the fall of the temperature becomes gentle and therefore, the temperature of the fixing device can be measured in a stable state. For example, as a method of changing the target temperature during the initial rotation in the printing operation and the heater electrical energization timing, such control as to set the target temperature to a high level because the fixing device is cold if the temperature after the lapse of a predetermined time after printing has been terminated is a predetermined temperature or lower, and to delay the timing for starting to electrically energize the heater for the prevention of the excessive rise in the temperature of the fixing device because the fixing device is hot if the temperature is higher than the predetermined temperature can be effected. Thereby, appropriate temperature control can be effected even during the printing operation in a state in which the fixing device is warm after the termination of the preceding printing operation, and hot offset and the slip of the fixing device can be prevented.

If conversely, the temperature is the predetermined temperature or lower, the fixing device is cold and therefore, target temperature during the initial rotation in the printing operation can be heightened. It is because the pressure roller can be more warmed within a limited fixing device raising time and bad fixing and the contamination of the pressure roller can e prevented that the target temperature during the initial rotation in the printing operation is set to a higher level than the fixing temperature when the paper is actually fixed.

(2) Also, an image forming apparatus having a fixing device having a heater, film sliding relative to the heater, and a pressure member brought into pressure contact with the heater with the film interposed therebetween to thereby form a fixing nip, and wherein a recording material having an unfixed image formed thereon is nipped and conveyed between the film and the pressure member at the fixing nip to thereby fix the unfixed image by the heat of the heater, further having an atmospheric temperature sensor for detecting the temperature of the atmosphere around the image forming apparatus, and wherein when the next printing is to be effected after the lapse of a predetermined time after the termination of any printing operation, the target temperature of the fixing device during the initial rotation in the printing operation and the heater electrical energization timing are changed in conformity with the atmospheric temperature detected by the atmospheric temperature sensor and the temperature of the fixing device.

That is, the image forming apparatus has an atmospheric temperature detecting sensor for detecting the temperature of the atmosphere around the image forming apparatus), and the target temperature during the initial rotation in the printing operation and the heater electrical energization timing are changed in conformity with body of the atmospheric temperature detected by the atmospheric temperature detecting sensor and the temperature of the fixing device after the lapse of the aforementioned predetermine time.

Because of the data of the atmospheric temperature, the setting of the target temperature during the initial rotation in the printing operation and the heater electrical energization timing can be effected more finely and accurately. For example, when the atmospheric temperature is high, the paper fed is warm and therefore the heater electrically energizing timing is delayed. Thereby, hot offset and the slip of the fixing device are reliably prevented. When the atmospheric temperature is low, the paper fed is cold and therefore, the target temperature can be changed to a high temperature to thereby prevent bad fixing.

According to the present invention, the temperature of the fixing device is monitored in a predetermined time after the termination of any printing operation, and the fixing device raising method, i.e., the target temperature (ready temperature) during the initial rotation in the printing operation and the heater electrical energization timing are changed in conformity with that temperature to thereby optimize the controlled temperature in the next printing, and prevent hot offset and the slip of the fixing device as well as bad fixing and the contamination of the pressure roller.

Further, by having the atmospheric temperature sensor and also controlling the detected data, there is the effect of being capable of determining the next controlled temperature more precisely.

DESCRIPTION OF THE PREFERRED EMBODIMENTS

First Embodiment (1) Example of the Image Forming Apparatus

Figure 1:
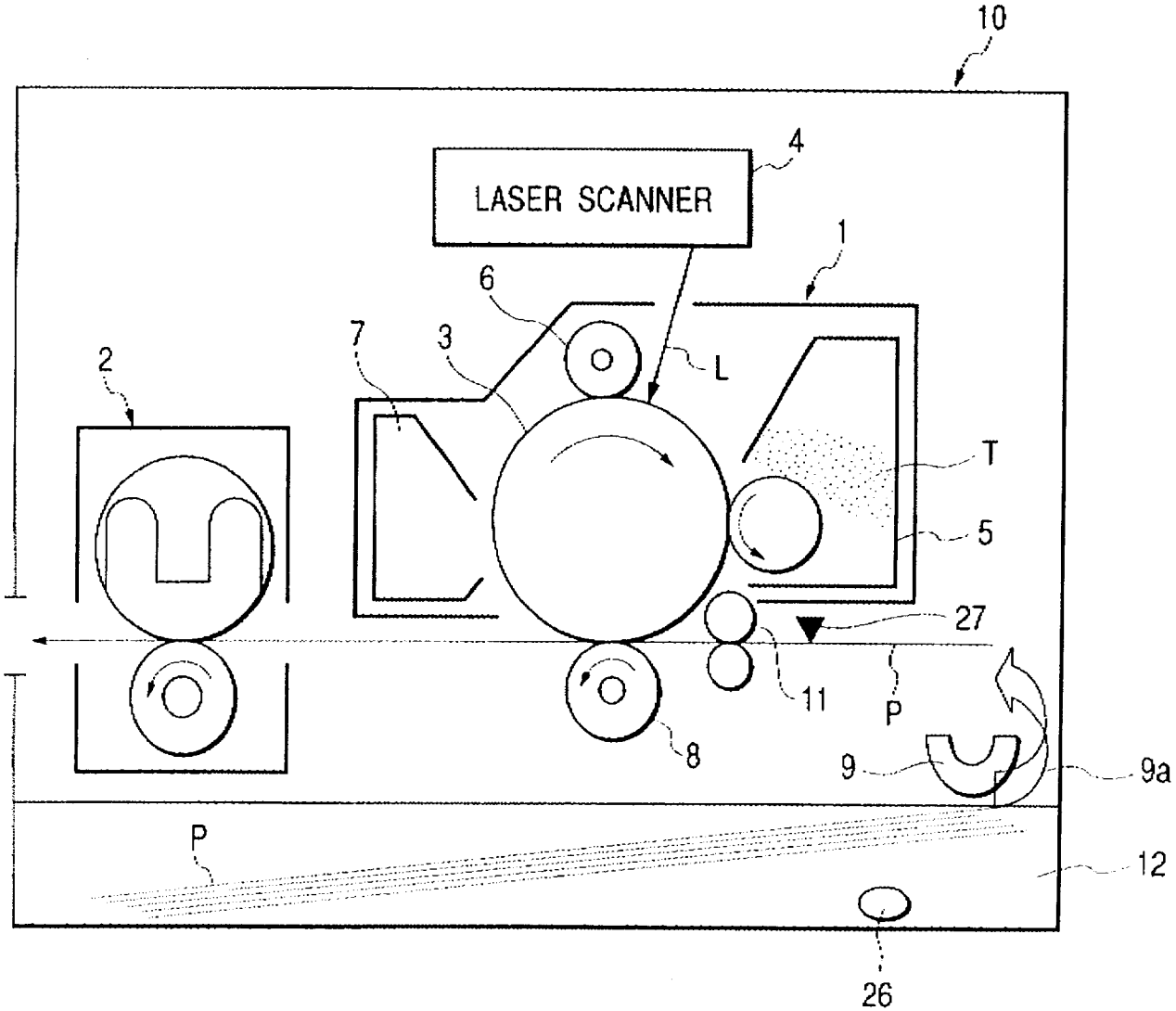
FIG. 1 schematically shows the construction of an image forming apparatus according to a first embodiment of the present invention.

FIG. 1 is a cross-sectional view schematically showing the construction of an embodiment of an image forming apparatus according to the present invention. The image forming apparatus of this embodiment is a laser beam printer using the transfer type electrophotographic process.

The reference numeral 10 generally designates the image forming apparatus, and the reference numeral 1 denotes a process cartridge detachably mountable with respect to the main body of the image forming apparatus. The process cartridge 1 in the present embodiment is comprised of four image forming process instruments, i.e., an electrophotographic photosensitive drum 3 as an image bearing member, a charging roller 6 as a charging device, a developing device 5 and a cleaning device 7.

The photosensitive drum 3 is constructed of a photosensitive material such as OPC, amorphous Se or amorphous Si formed on a cylinder-shaped substrate of aluminum, nickel or the like.

The photosensitive drum 3 is rotatively driven at a predetermined peripheral speed in the clockwise direction of arrow, and the surface thereof is uniformly charged by the charging roller 6 as the charging device.

Next, the surface of the photosensitive drum is subjected to image exposure L by a laser scanner 4 which is an image exposure device. The laser scanner 4 outputs a laser beam ON/OFF-modulation-controlled correspondingly to the time-series electrical digital pixel signal of image information, and scans and is exposes the charging-processed surface of the rotating photosensitive drum 3. By this scanning and exposure, the electrostatic latent image of the image information is formed on the photosensitive drum 3.

The electrostatic latent image is developed and visualized as a toner image by the developing device 5. As a developing method, a jumping developing method or the like is used, and is often used in combination with image exposure and reversal development. In the present embodiment, use is made of a developing device using an insulation monocomponent toner T as a developer. When the toner T in this developing device 5 is consumed, the process cartridge 1 is interchanged with a new process cartridge 1.

A recording material (hereinafter referred to as the paper sheet) P is taken out of a manual tray (not shown) or a cassette 12 by a feed roller 9, and passes a surface reverse sheet path 9*a* and is fed to registration roller 11. The reference numeral 27 designates a top sensor, and a top signal is outputted in a predetermined time after the timing at which the leading end of the paper sheet has passed the top sensor 27, and the image forming operations are successively started from the timing of the top signal. The fed paper sheet P is supplied to a transfer nip portion formed by the photosensitive drum 3 and a transfer roller 8, in synchronism with the toner image formed on the surface of the photosensitive drum 3, by the registration rollers 11, and is nipped and conveyed with a constant pressure force. At the transfer nip portion, the toner image on the photosensitive drum 3 is electrostability transferred to the paper sheet P by the action of a transfer bias voltage by a voltage source, not shown.

The paper sheet P having passed the transfer nip portion is separated from the surface of the photosensitive drum 3, and is conveyed to a fixing device 2 while bearing the toner image thereon, and is heated and pressurized be the fixing nip portion of the fixing device 2, whereby the toner image is fixed on the paper sheet P and becomes a permanent image, and the paper sheet P is delivered out of the apparatus.

On the other hand, after the separation of the paper sheet, the rotating photosensitive drum 3 has any untransferred toner remaining on its surface removed by the cleaning device 7, and is repeatedly used for image formation.

(2) Operation Sequence of the Image Forming Apparatus.

Figure 2:
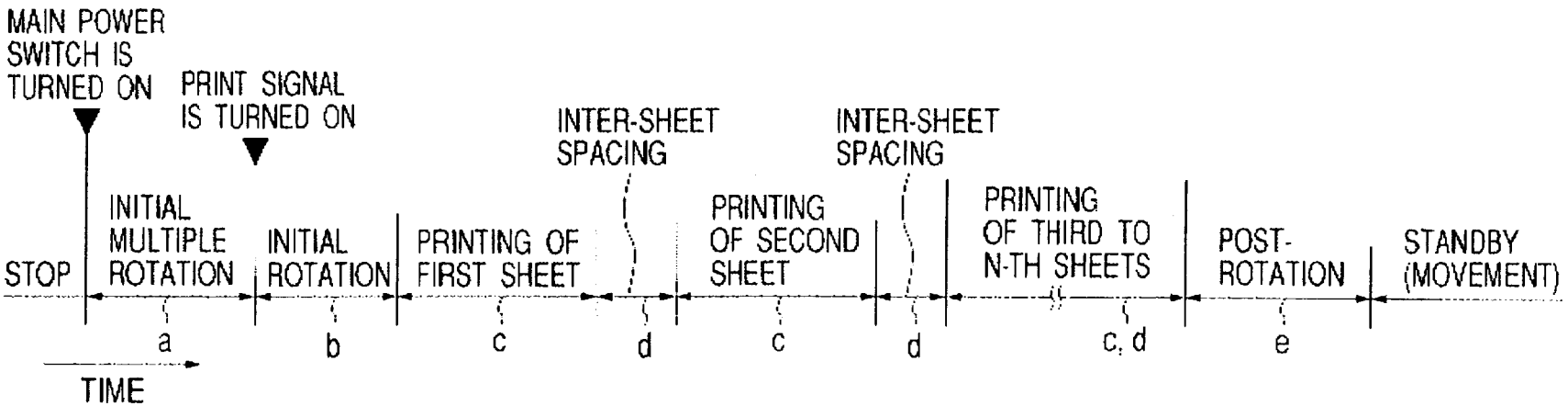
FIG. 2 is an operation sequence diagram of the image forming apparatus.

FIG. 2 is an operation sequence diagram of the above-described image forming apparatus.

a. Initial multiple Rotation Operation: This is the starting operation period (the actuating operation period and the warning period) of the image forming apparatus. By the main power source switch ON, the main motor of the apparatus is driven to thereby rotatively drive the photosensitive drum 3 and execute the preparatory operation of predetermined process instruments.

b. Initial Rotation Operation: This is a period for executing the ante-printing operation. This initial rotation operation is executed subsequently to the initial multiple rotation operation when a print signal is inputted during the initial multiple rotation operation. When there is not the input of the print signal, the driving of the main motor is once stopped after the termination of the initial multiple rotation operation and the rotative driving of the photosensitive drum 3 is stopped, and the image forming apparatus is kept in a standby state until the print signal is inputted. When the print signal is inputted, the initial rotation operation is executed.

c. Printing Operation: When a predetermined initial rotation operation is terminated, the image forming process on the rotating photosensitive drum 3 is executed continuously, and the transfer of the toner image formed on the surface of the rotating photosensitive drum to the recording material P and the fixing of the toner image by the fixing device 2 are done and an image-formed article is printed out. In the case of a continuous printing mode, the above-described printing operation is repeatedly executed for a predetermined set number of printed sheets.

d. Inter-sheet Spacing: This is the non-sheet passing state period of tho recording material at the transfer nip portion in the continuous printing mode from after the trailing end of a recording material has passed the transfer nip portion until the leading end of the next recording material arrives at the transfer nip portion.

e. Post-rotation Operation: This is a period during which the driving of a main motor is still continued for a while after the printing operation for the last recording material has been completed, whereby the photosensitive drum 3 is rotatively driven and a predetermined post-operation is executed.

f. Standby: When the predetermined post-rotation operation is terminated, the driving of the main motor is stopped and the rotative driving of the photosensitive drum 3 is stopped, and the image forming apparatus is kept in its standby state until the next printing start signal is inputted.

In the case of the printing of only one sheet, after the completion of the printing thereof, the printer assumes its standby state via the post-rotation operation.

When in the standby state, a printing start signal is inputted, the printer shifts to the initial rotation operation.

The time of the printing operation indicated by the reference sign "c" is the image forming time, and the initial multiple rotation operation indicated by the reference sign "a", the initial rotation operation indicated by the reference sign "b", the inter-sheet spacing indicated by the reference sign "d" and the post-rotation operation indicated by the reference sign "e" are the non-image forming time (non-printing time).

(3) Fixing Device 2

Figure 3:
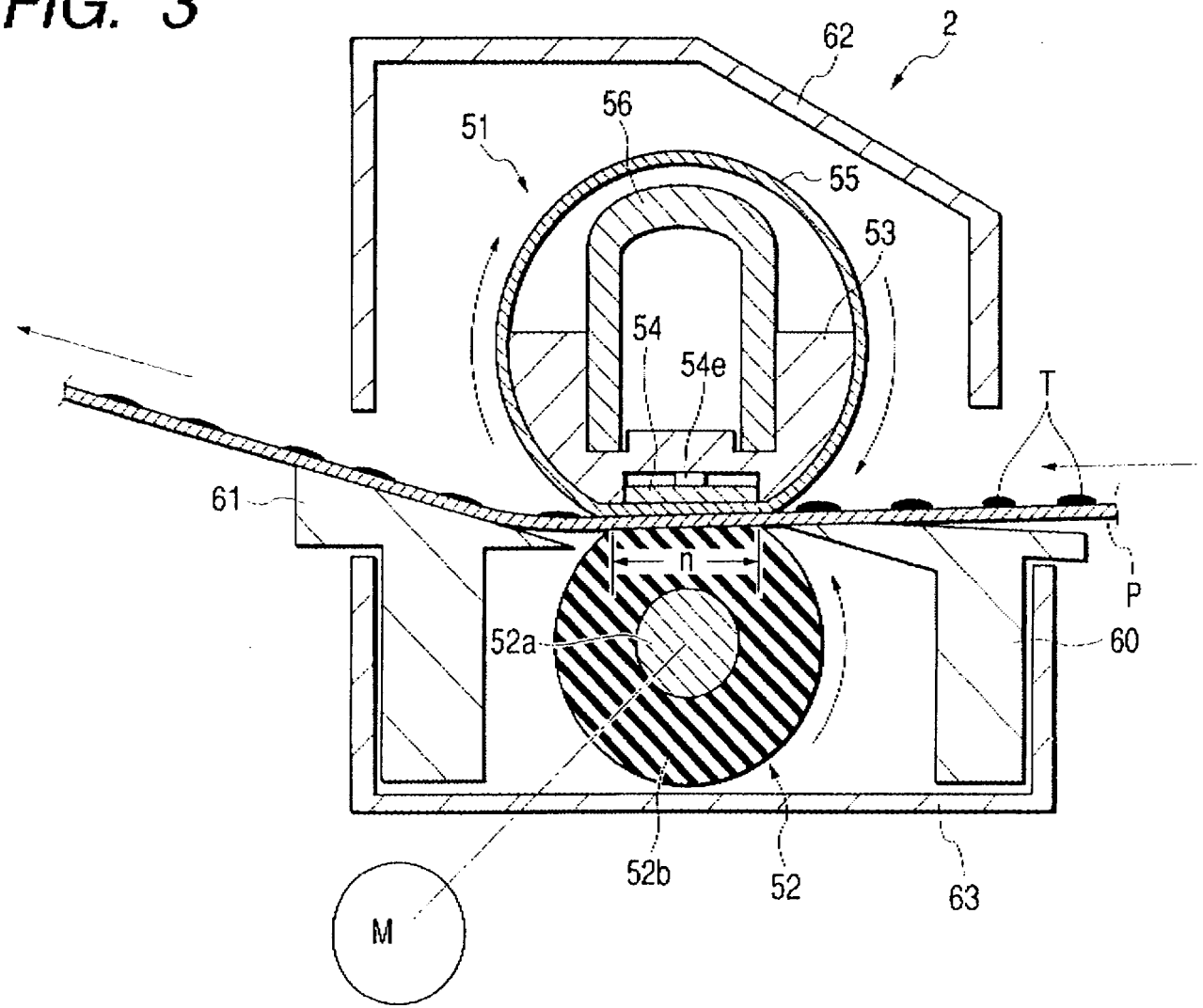
FIG. 3 is an enlarged transverse cross-sectional view of a fixing device.

FIG. 3 is an enlarged transverse cross-sectional view of the fixing device. The fixing device 2 in the present embodiment is an on-demand fixing device of the film heating type or the pressure rotary member driving type (tensionless type) using cylindrical (endless-belt-shaped) disclosed in Japanese Patent Application Laid-Open Nos. 4-44075 to 44083, 4-204980 to 204984, etc.

The reference numeral 51 designates a fixing member (fixing unit), and the reference numeral 52 denotes a pressure roller as a pressure rotary member, and a fixing nip portion n is formed by the pressure contact between the two members 51 and 52.

The fixing member 51 is a member having a direction perpendicular to the plane of the drawing sheet as the lengthwise direction, and comprises a heat-resistant and rigid film guide member 53 having a substantially semicircular trough-shaped transverse cross-section, a heater (heating member) 54 fitted and fixedly disposed in a concave groove portion provided in the underside of the film guide member 53 along the length thereof and generating heat by electrical energization, cylindrical heat-resistant fixing film 55 loosely fitted on the film guide member 53 having the heater 54 mounted thereon, and a rigid pressure stay 56 inserted into the inside of the film guide member 53.

The pressure roller 52 is a rotary member comprising a mandrel 52*a* and an elastic layer 52*b* provided on the mandrel concentrically and integrally therewith and formed of heat-resistant rubber such as silicone rubber or fluorine rubber or foamed silicone rubber or the like. A heat-resistant mold-releasing layer formed of fluorine resin such as PFA, PTFE or FEP may be formed on the elastic layer 52*b*.

The pressure roller 52 is disposed with the opposite end portions of the mandrel 52*a* rotatably hold between the side plates of all apparatus chassis on this side and the inner side through bearing members.

In the fixing device 51, the rigid pressure stay 56 is disposed on and in parallel to the upper side of the pressure roller 52 with its heater 54 side facing downward. The opposite end portions of the rigid pressure stay 56 are biased axially of the pressure roller 52 by a pressure biasing member such as a spring, not shown, whereby the downwardly facing surface of the heater 54 is brought into pressure contact with the elastic layer 52*b* of the pressure roller 52 with a predetermined pressure force against the elasticity of the elastic layer 52*b* with the fixing film 55 interposed therebetween, and the fixing nip portion n having a predetermined width is formed. There can also be adopted a device construction in which the pressure roller 52 is pushed up and biased against the underside of the fixing member 51 by a pressure biasing member to thereby form the fixing nip portion n having a predetermined width.

The pressure roller 52 is rotatively driven in the counterclockwise direction of arrow at a predetermined peripheral speed by driving means M. A rotational force acts on the cylindrical fixing film 55 by the pressure contact frictional force at the fixing nip portion n between the outer surface of the pressure roller 52 and the fixing film 55 by the rotative driving of the pressure roller 52 and thus, the fixing firm 55 is driven to rotate in the clockwise direction of arrow around the film guide member 53 with its inner surface sliding inclose contact with the downwardly facing surface of the heater 54.

The construction and control of the heater 54 will now be described in detail in the next paragraphs (4) and (5).

The film guide member 53 is a molded article of heat-resistant resin such as PPS or a liquid crystal polymer, and ploys the role of a guide member supporting the heater 54 and urging the smooth rotation of the fixing film 55.

The fixing film 55 has a film thickness of 100 $\mu$m or less in total, and in the present embodiment, 60 $\mu$m, in order to make the heat capacity thereof small and improve its quick starting property. The fixing film 55 is single-layer film of PTFE, PFA, PPS or the like having heat resistance, a mold-releasing property, strength, durability, etc., or compound-layer film having a film surface of polyimide, polyamideimide, PEEK, PES or the like coated with PTFE, PFA, FEP or the like as a mold-releasing layer.

In a state in which the pressure roller 52 is rotatively driven and therewith, the cylindrical fixing film 55 is driven to rotate and the heater 54 is electrically energized and rises in temperature and is controlled to a predetermined starting temperature, a paper sheet (recording material) P bearing an unfixed toner image T thereon is introduced into between the fixing film 55 and the pressure roller 52 in the fixing nip portion n, and the paper sheet P is nipped and conveyed by the fixing nip portion n together with the film 55 with its toner image bearing surface brought into close contact with the outer surface of the fixing film 55 in the fixing nip portion n. In this nipping and conveying process, the heat of the heater 54 is imparted to the paper sheet P through the fixing film 55, and the unfixed toner image T on the paper sheet P is heated and pressurized and is fused and fixed. The paper sheet P having passed the fixing nip portion n is self-stripped from the fixing film 55. The reference numerals 62 and 63 designate the upper and lower housings of the fixing device, and the reference numerals 60 and 61 denote guide members on the recording material entrance side and exit side provided in the lower housing 63.

(4) Heater 54

The heater 54 in the present embodiment is a so-called ceramic heater. Ceramic heaters of various forms of construction are known, and a typical form of construction is an elongate planar member generally of low heat capacity comprising a ceramic substrate of $Al_2O_3$ (alumina), AIN (aluminum nitride) or the like and paste of an electrically energized heat generating resistance material such as Ag/Pd printed and sintered thereon to thereby form a heat generating member, and further a glass coating layer formed thereon to secure the protection and insulativeness of the heat generating member, and generally quickly rises in temperature by the electrical energization of the heat generating member.

Figures 4A, 4B, 4C:
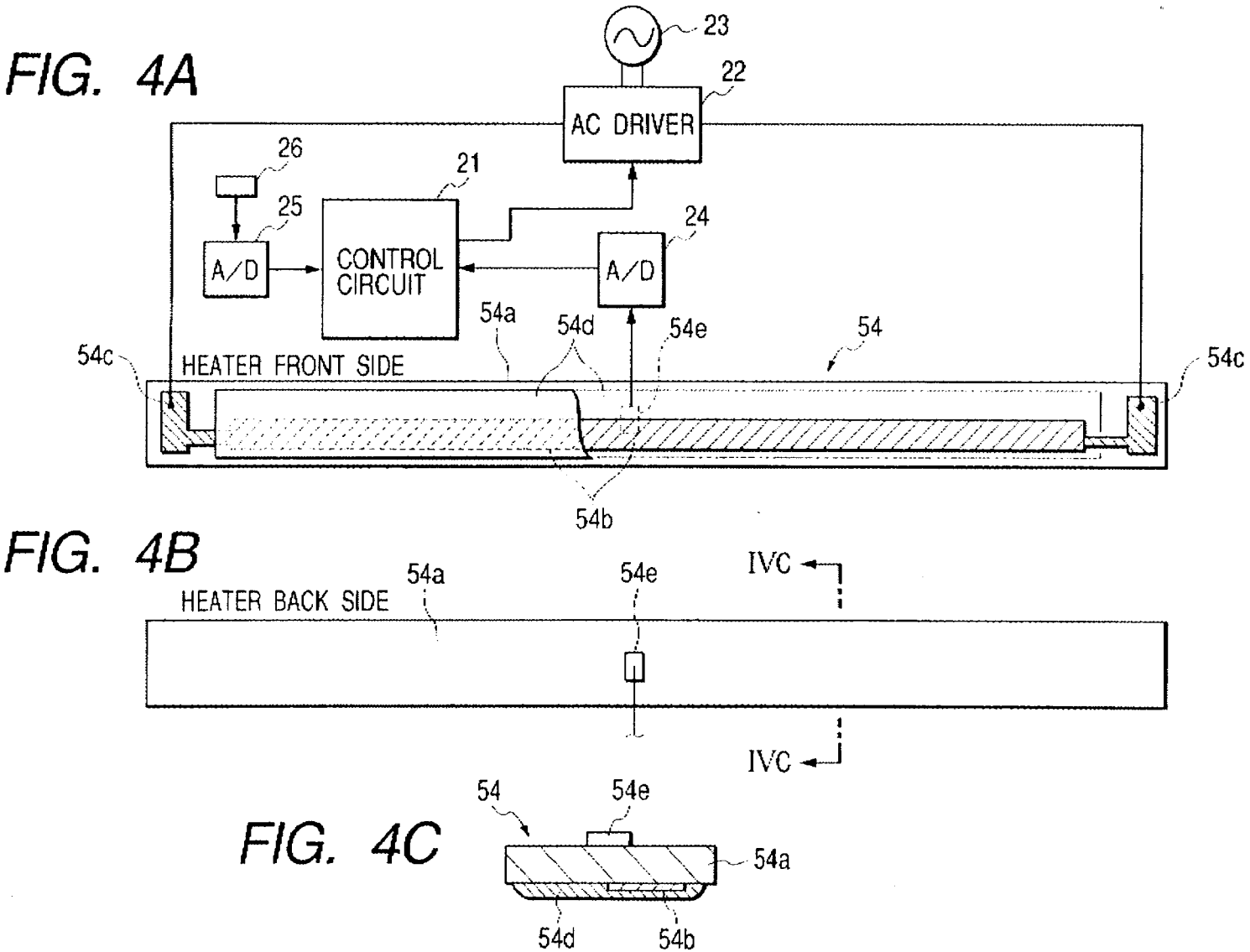
FIGS. 4A, 4B and 4C are illustrations of the construction of a heater.

FIGS. 4A, 4B and 4C are illustrations of the construction of the heater 54 used in the present embodiment. FIG. 4A is a partly cut-away plan model view the surface side of the heater and a block diagram of a control system, FIG. 4B is a plan model view of the back side of the heater, and FIG. 4C is an enlarged transverse cross-sectional model view taken along the line IVC—IVC of FIG. 4B.

The reference sign 54*a* designates an $Al_2O_3$ substrate as a heater substrate which is a laterally long thin plate member having a direction perpendicular to the paper passing direction as the lengthwise direction.

The reference sign 54*b* denotes an electrically energized heat generating resistance layer (hereinafter referred to as the heat generating member) formed along the length of one surface of the heater substrate 54*a*. This electrically energized heat generating resistance layer 54*b* can be provided by forming a pattern as by screen printing by the use of electrically energized heat generating resistance material paste such as silver palladium (Ag/Pd) or $Ta_2N$, and sintering it.

The reference sign 54*c* designates electrode patterns for electric power supply formed on the surfaces of the opposite end portions of the heater substrate 54*a*, and electrically connected to one end portion and the other end portion of the heat generating member 54*b* through extension circuits. Each electrode pattern 54*c* for electric power supply and each extension circuit can be provided by forming a pattern as by screen printing by the use of conductor paste such as silver (Ag), and sintering it.

The reference sign 54*d* denotes a plurality of glass layers of good heat conductivity for securing the protection and insulativeness of the heat generating member 54*b*.

The reference sign 54*e* designates a thermistor as a temperature detecting sensor for detecting the temperature of the heater, and it is printed on or adhesively secured to the back side of the heater substrate 54*a*.

The heater 54 is disposed with the surface side of the heater substrate 54*a* which is formed with the heat generating member 54*b* and the glass layer 54*d* (the heater surface side) disposed outside and fixed to the underside of the film guide member 53, and the inner surface of the fixing film 55 is in close contact with this heater surface and slides relative thereto.

The reference numeral 21 denotes a contact circuit (control CPU), the reference numeral 22 designates an AC driver, and the reference numeral 23 denotes a commercially available AC power source. The electrode pattern 54*c* for electric power supply of the heater 54 and the AC driver 22 are electrically connected together through a connector (not shown). The AC driver 22 is controlled by the control circuit 21. The electrical temperature detection information of the thermistor 54*e* as the temperature detecting element for detecting the temperature of the heater is inputted to the control circuit 21 through an A/D converter 24.

The reference numeral 26 (FIGS. 1 and 4A) designates an atmospheric temperature detecting element (atmospheric temperature detecting thermistor) provided at an appropriate location in the image forming apparatus. The detection information of this element 26 is also inputted to the control circuit 21 through an A/D converter 25. This atmospheric temperature detecting element 26 is used in Embodiments 3 and 5 which will be described later and therefore, need not be provided in the other embodiments.

The control circuit 21 controls the AC driver 22 to thereby electrically energize the heat generating member 54*b* of the heater 54 and cause it to generate heat.

By the heat generating member 54*b* of the heater 54 being electrically energized as described above, the heat generating member 54*b* generates heat and the heater 54 quickly rises in temperature. The temperature information of the heater 54 is inputted from the thermistor 54*e* to the control circuit 21 through the A/D converter 24. On the basis of the inputted temperature information, the control circuit 21 controls the AC driver 22 to control the temperature of the heater to a predetermined constant temperature. That is, by a power-controlled alternating current flowing to the heat generating member 54*b* of the heater 54, the temperature of the heater is designed to be controlled to a predetermined fixing temperature.

(5) Slip Prevention Control

When at the start of printing, the output of the thermistor 54*e* near the heater 54 is detected and the temperature difference $\Delta T-T2-T1$ between the detected temperature T1 and the fixing temperature T2 is smaller than a desired temperature T0, the timing of rise of the heater is delayed. Thereby, at the hot start, the slip can be prevented without the pressure roller being excessively warmed.

Figure 5:
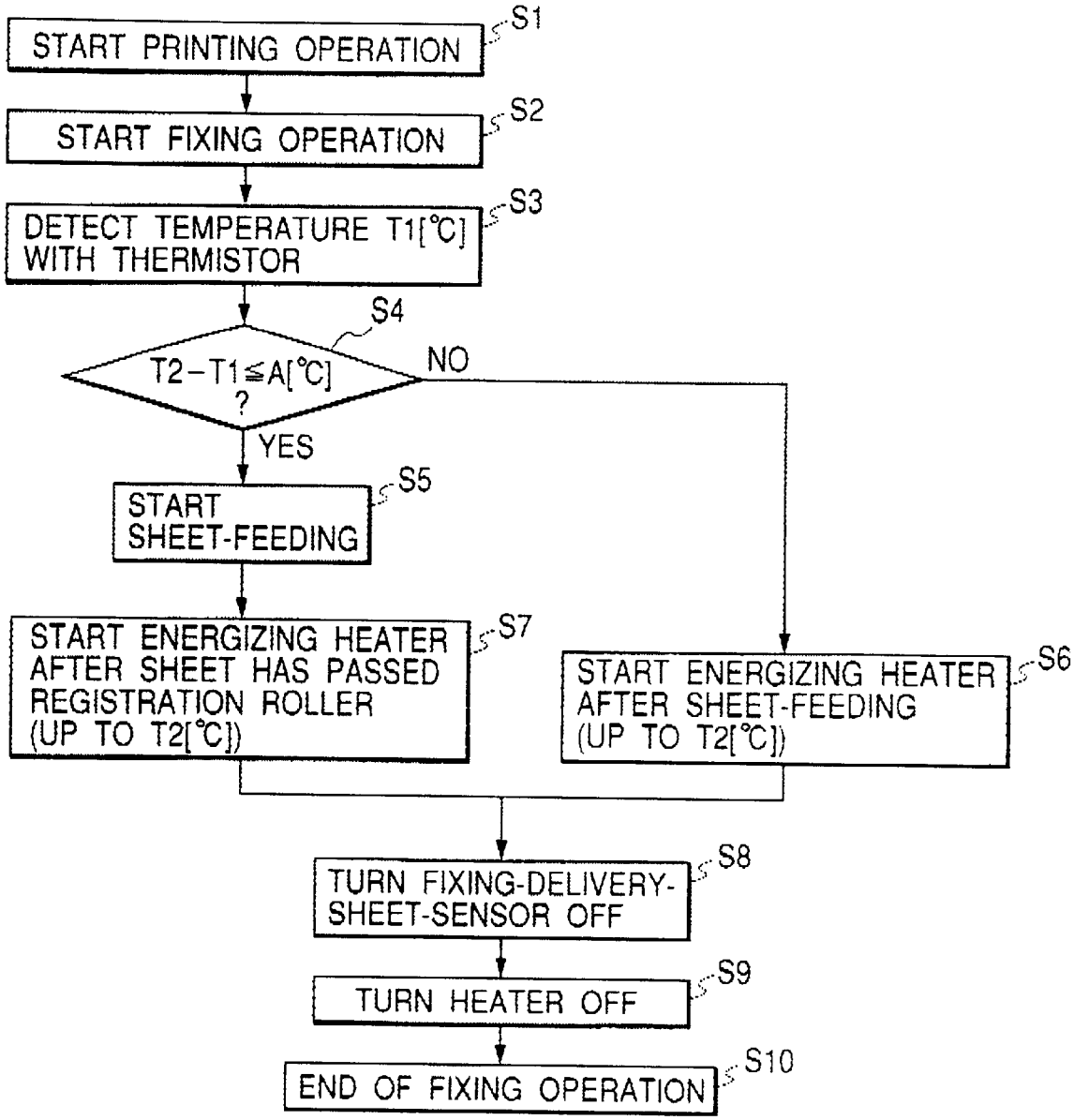
FIG. 5 is a heater ON timing flowchart.

A flowchart of the fixing temperature control in the present embodiment is shown in FIG. 5. Referring to FIG. 5, in a state in which the pressure roller 52 is warmed in intermittent printing, the heater ON timing is delayed to thereby prevent the pressure roller 52 from being excessively warmed.

Figure 6:
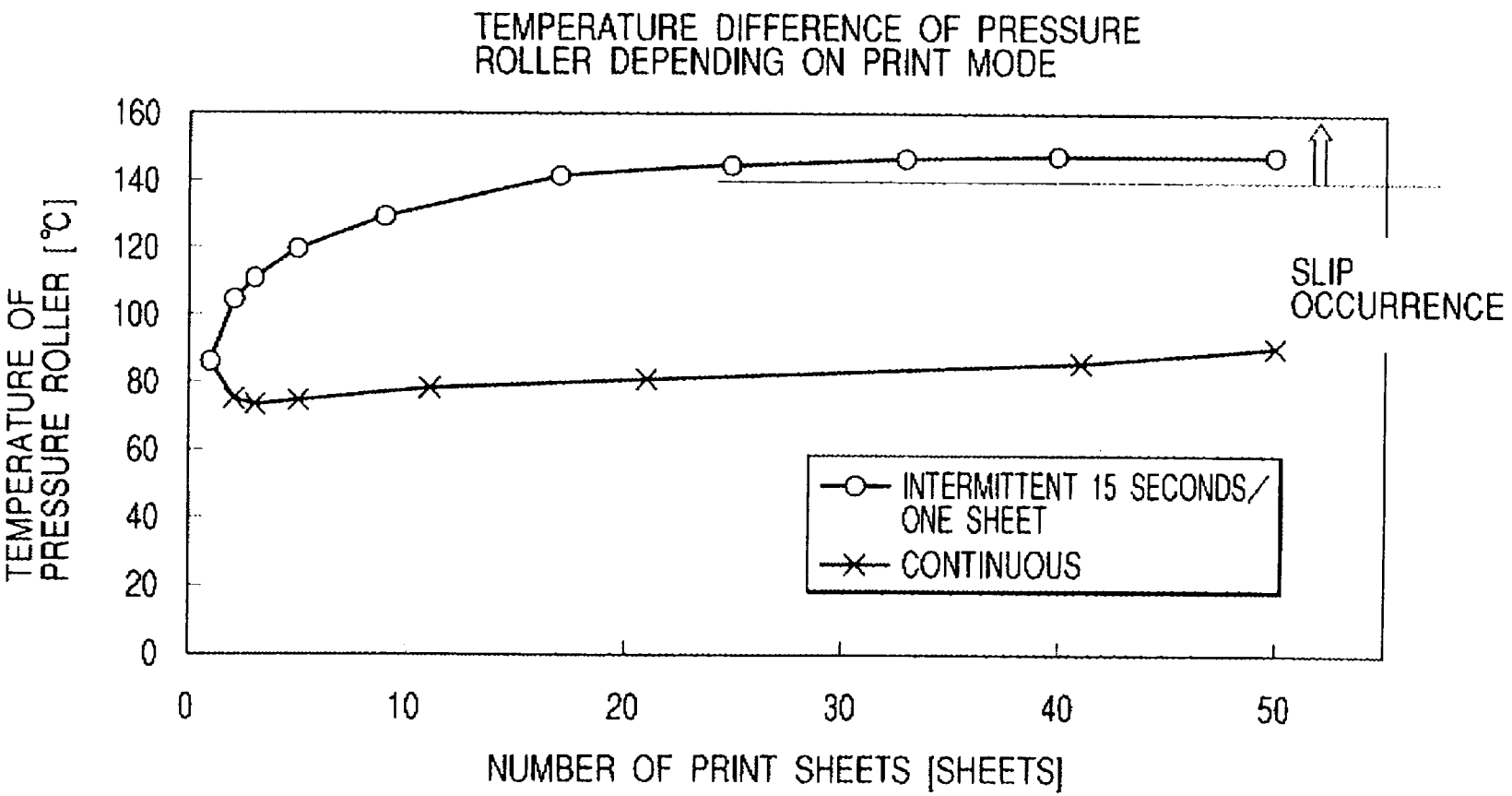
FIG. 6 is a graph of the temperature difference of a pressure roller.

The flow chart will hereinafter be described. First, the flowchart of FIG. 5 is applied to a case where the pressure roller 52 is sufficiently warmed in intermittent printing. That is, during continuous printing, as shown in FIG. 6, the pressure roller 52 is not warmed so much as in intermittent printing and the creation of steam is little and therefore the slip does not occur.

In FIG. 5, when a printing signal is received from a personal computer or the like, not shown, the printing operation is started (step S1).

Here, the fixing operation is also started substantially simultaneously with the rotation of the scanner 4 and the photosensitive drum 3 (step S2). As the fixing operation, the thermistor 54*e* effects temperature detection T1(° C.) (step S2). When the target heater temperature of the fixing step is T2(° C.), when $T2-T1 \leqq A$(° C.) is NO, the electrical energization of the heater is started immediately after the feeding of the paper sheet P from the cassette 12, and the heater is raised to T2 (step S6).

Conversely, in the case of YES, the electrical energization of the heater is effected at a point of time whereat after the feeding of the paper sheet from the cassette, the paper sheet has passed the registration rollers 11 before it enters the transfer nip, and the heater is raised to T2 (step S7). That is, the latter is later in the heater ON timing and is shorter in the heating time until the paper sheet enters the fixing nip. Therefore, the pressure roller 52 is not excessively warmed and does not reach a slip causing temperature, and the slip can be prevented.

Also, even if at the step S7, the pressure roller 52, the film guide member 53, the rigid pressure stay 56, etc. are sufficiently warmed and the heating time of the heater becomes short due to the remaining heat of these, bad fixing will not occur when the paper sheet enters the fixing nip.

Experiment 1

Here, the confirmation of a change in the temperature of the pressure roller and the slip during intermittent printing in an example of the conventional art and the present embodiment was effected by the use of the image forming apparatus according to the present embodiment.

The conditions in this experiment are as follows.

Process speed: 30π=94.2 mm/sec.

First printing time: 13 sec.

Heater ON timing changeover: set to T2−T1≦A=70(° C.).

Fixing film 55: a construction in which polyimide having a thickness of 50 μm is a base layer and a PFA layer having a thickness of 10 μm is provided thereon, and the inner diameter of the film is 25ϕ.

Heater 54: Ag/Pb paste is pressed and printed on an $Al_2O_3$ substrate, and is sintered to thereby prepare a heat generating member, and a glass coating layer of 50–60 μm is provided thereon.

Thermistor 54*e*: a chip-like thermistor is adhesively secured to the back side of the heater base.

Pressure roller 52: a rubber layer of 4 mm comprising thermoset liquid silicone rubber is applied onto an aluminum mandrel of ϕ12, and a PFA tube of 50 μm is primer-secured as a mold-releasing layer to the surface layer—outer diameter of about ϕ22.

Toner T: an insulating mono-component magnetic toner having a volume average particle diameter of 5.8 μm.

Paper sheet P: Office reader A4 of 64 g/m$^2$ having a moisture content of 8.5% and left at 23° C./70%.

Printing pattern: a black solid image of a coverage rate 100%.

Figure 7:
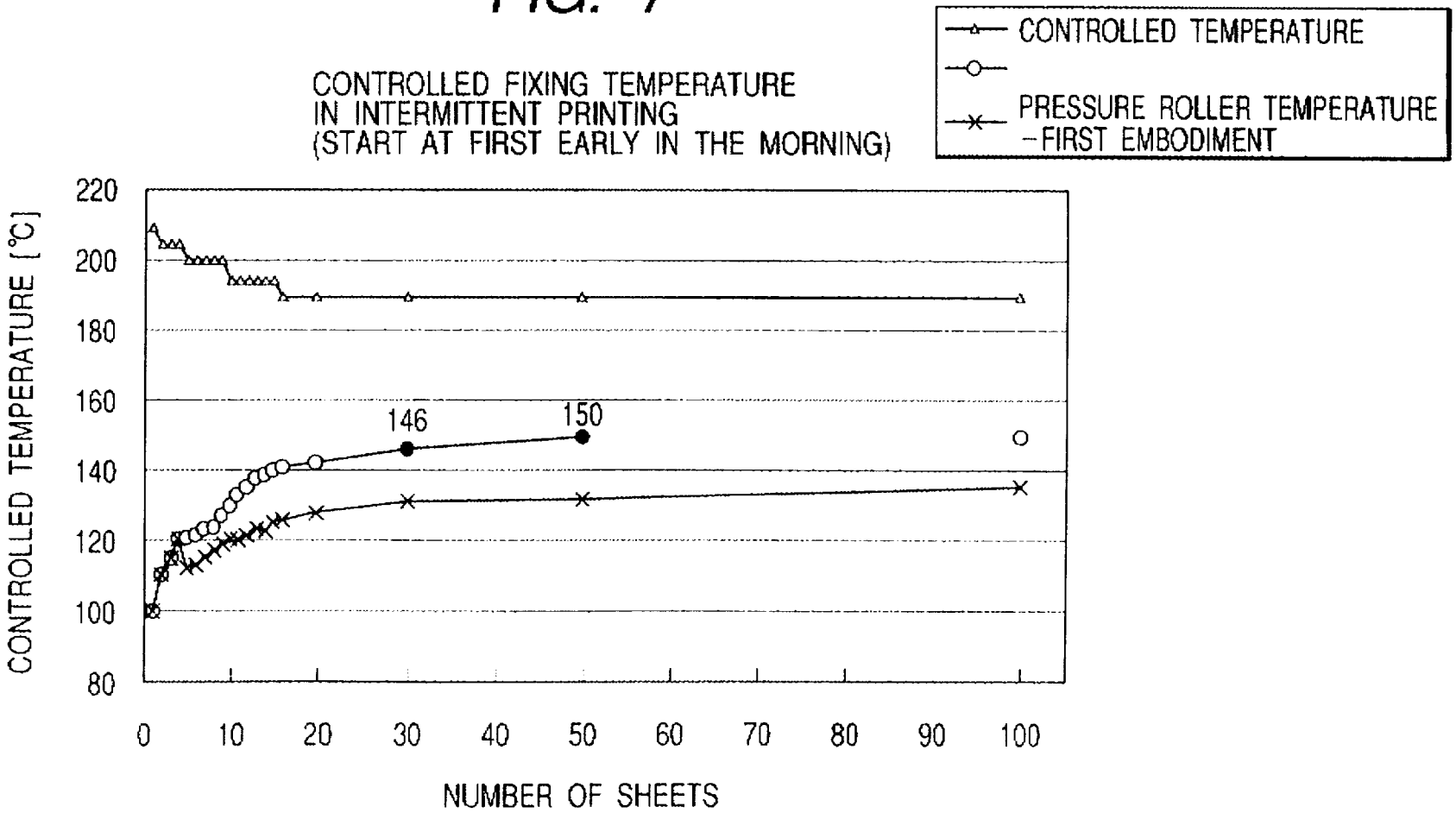
FIG. 7 is a graph showing the result of Experiment 1.

Under the above-described conditions, the confirmation of the slip and the temperature of the pressure roller was effected for the intermittent printing of 100 sheets at a pause of 2 sec. per printed sheet. FIG. 7 shows the cold start at first early in the morning, and FIG. 8 shows the result of hot start in a state in which the pressure roller 52 was warmed by sheet supply.

First, in FIG. 7, in the example of the conventional art, the slip occurred for the 30th sheet and the 50th sheet and the temperatures of the pressure roller were 146° C. and 150° C., respectively, whereas in the present embodiment, the heater ON timing changeover operated from the 5th sheet and the heater ON became late, whereby even when 100 sheets were printed, the temperature of the roller was 135° C., and the slip did not occur.

Figure 8:
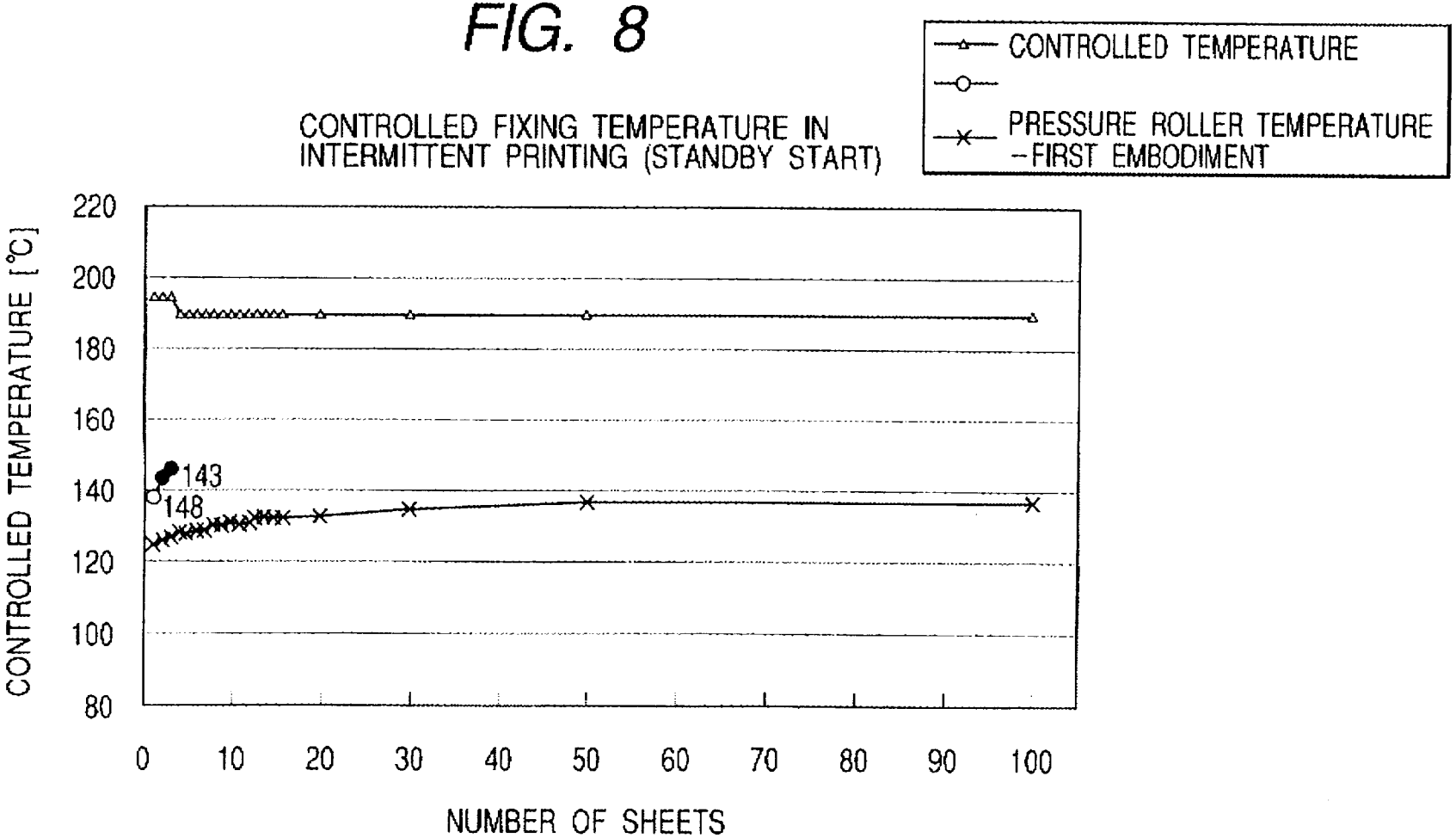
FIG. 8 is a graph showing the result of Experiment 1.

Again in FIG. 8, in the example of the conventional art, the temperatures of the pressure roller were 143° C. and 146° C. for the 2nd sheet and the 3rd sheet, respectively, from the start of printing, and the slip occurred, whereas in the present embodiment, the heater ON timing changeover operated from the 1st sheet, arid even when 100 sheets were supplied, the temperature of the pressure roller was 137° C. and the slip did not occur.

As the result of further investigation, it has been confirmed that the setting of the temperature difference A of T1−T2 which is the condition for changing over the heater ON timing differs depending on the setting of the heater temperature, the rising time of the heater and the heat capacity of the pressure roller 52, but generally a good result is shown for. A=40 to 80° C. or so.

Also, while in the flowchart of FIG. 5, the aforementioned changeover is effected by selecting after-the-sheet-feeding and after-passing-the registration-rollers, it may be effected in synchronism with the ON timing of a sheet feed sensor and a registration sensor, not shown, disposed on a feed roller and a registration unit, respectively, or a similar effect can be expected every if it is operated with time calculated from the timer clock of the control circuit (control CPU) 21.

As described above, even when subsequently to intermittent printing, the pressure roller 52 is sufficiently warmed by the remaining heat during the printing, the temperature of the heater at the start of the printing is detected and the heater ON timing is delayed in conformity with the temperature difference between that temperature and the target temperature of the heater to thereby effect raising. Thus, the pressure roller 52 is not excessively warmed during the rise of the heater and even if a paper sheet P having absorbed moisture is nipped by the fixing nip portion n, the amount of steam created between the pressure roller 52 and the paper sheet P is small, and even if the paper sheet P contacts with the pressure roller 52, the latter will not slip. Consequently, even in intermittent printing, the driving force of the pressure roller 52 can be stably transmitted to the film 55 through the paper sheet P, and it becomes possible to prevent the slap and stabilize the conveyance of the fixed paper sheet. Also, even if the heater ON timing is delayed, it becomes possible to raise the heater up to the target heater temperature within a short time because the pressure roller, the film guide, etc. are sufficiently warmed, and the temperature necessary for fixing can be sufficiently secured, and bad fixing does not occur but good fixed images can be provided.

Second Embodiment

For media called thick paper, for example, bond paper having basis weight of 105 g/m$^2$, the quantity of beat necessary for fixing is great and a high fixing temperature is often used. At this time, the user operates the printer driver software on a personal computer, whereby the fixing device is often used as a high mode (a mode in which a high fixing temperature is set). Thick paper such as bond paper is rough in surface property and even if it has more or less absorbed moisture by being left as it is, created steam goes out from the surface of the paper, whereby the slip has not occurred. However, when in a state in which after bond paper has been printed in the high mode, the temperature of the pressure roller has become still higher, the user has printed moisture-absorbing paper of 64 g/m$^2$ shown in the aforedescribed first embodiment (Embodiment 1) without returning the fixing temperature setting from the high mode to an ordinary mode, the slip has occurred as in the example of the conventional art.

Figure 9:
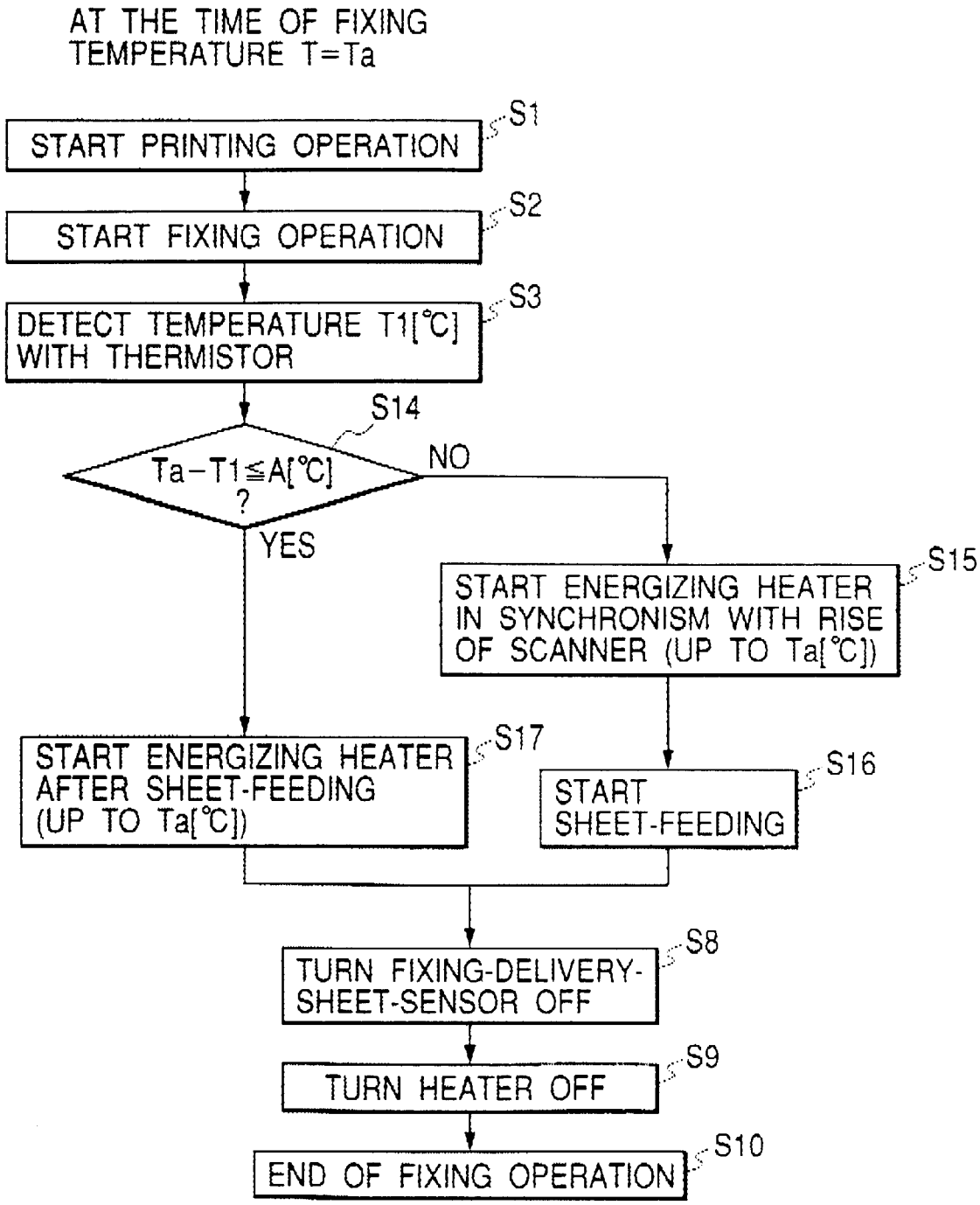
FIG. 9 is a heater ON timing flowchart 1 according to a second embodiment of the present invention.
Figure 10:
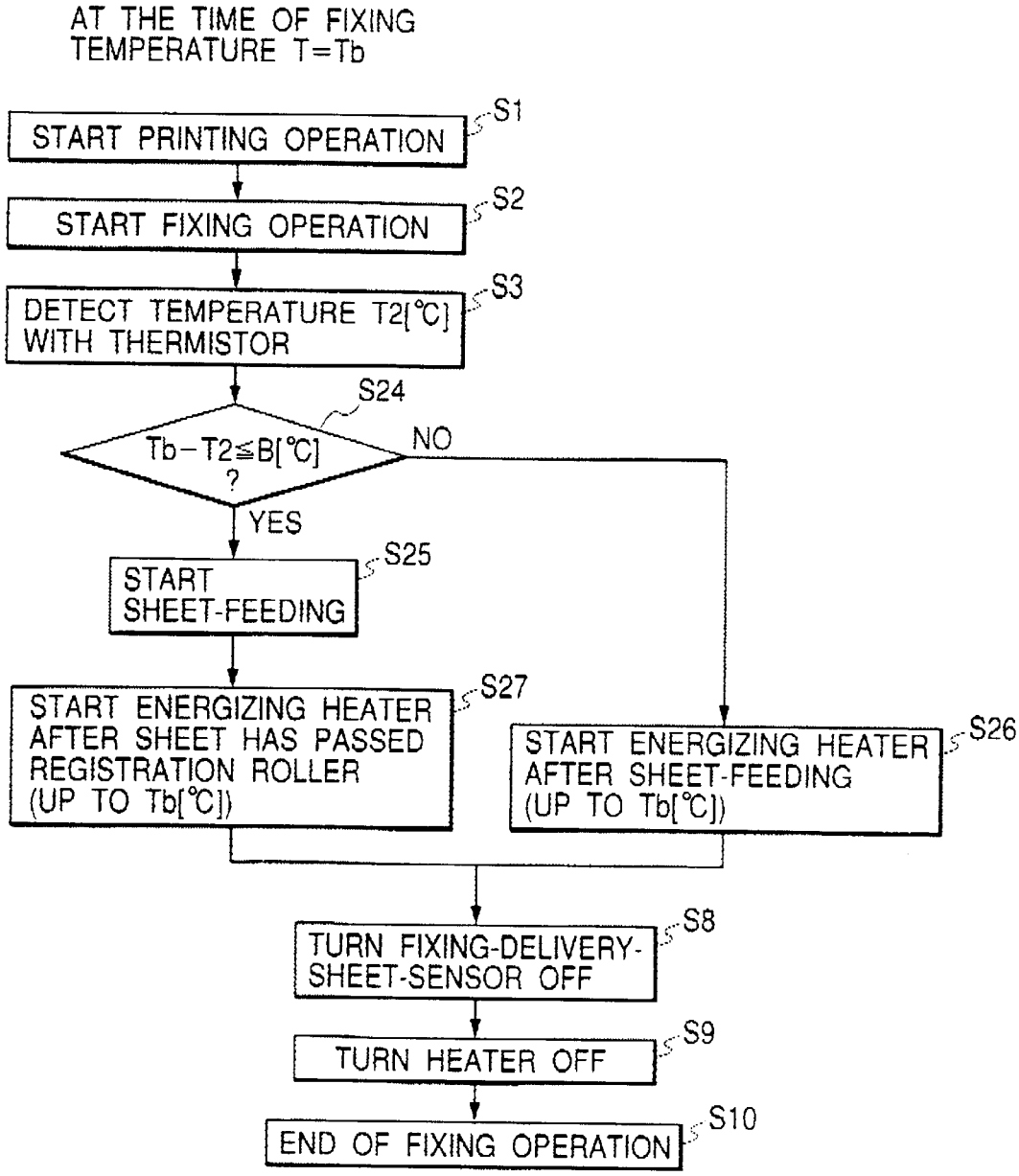
FIG. 10 is a heater ON timing flowchart 2.
Figure 11:
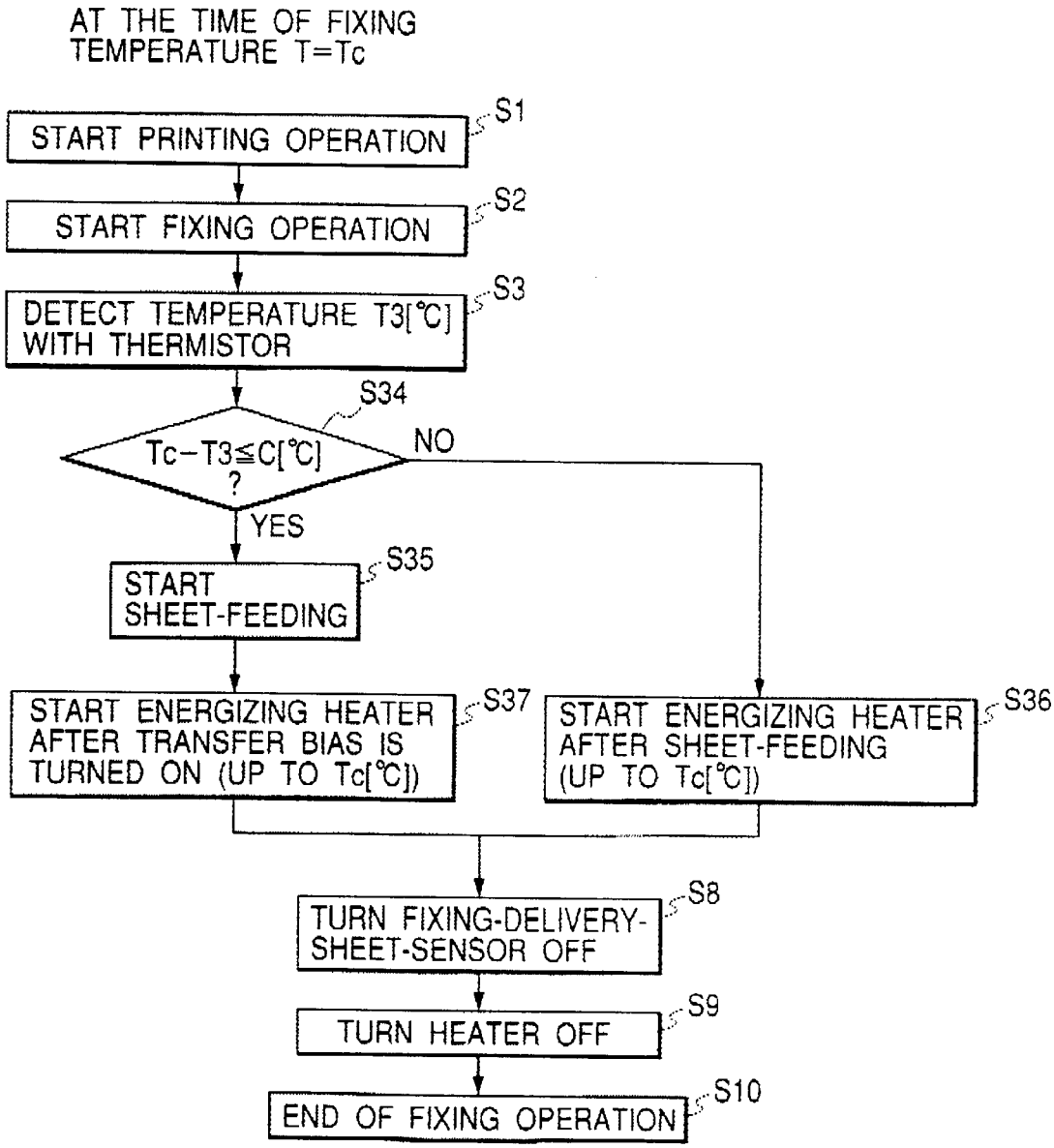
FIG. 11 is a heater ON timing flowchart 3.

So, a second embodiment will be described hereinafter. FIGS. 9 to 11 are flow charts showing the heater ON timing in the present embodiment. Referring to these figures, design is made such that the heater ON timing at the start of printing is changed over a plurality of times in conformity with the temperature difference between the target heating temperature of the heater and the thermistor near the heater. The construction, etc. of the image forming apparatus are similar to those in the first embodiment.

That is, in the present embodiment, provision is made of such three operating modes that the fixing temperatures (target heating temperatures) to be selected in conformity with the thickness or the like of a paper sheet are Ta, Tb and Tc. Here, they are set to Ta<Tb<Tc (° C.). In an operating mode wherein the fixing temperatures are Ta, Tb and Tc, the heater ON timing is changed over when the temperature differences between the fixing temperatures Ta, Tb, Tc and the thermistor temperature at the start of printing are A, B and C (° C.). In the present embodiment, A, B and C are set to A>B>C.

FIG. 9 is a flowchart in the case of an operating mode in which the fixing temperature is Ta. In conformity with the above-mentioned temperature difference, the electrical energization starting timing is changed over to one of the timing at which the rotation of the scanner is started at the start of printing (before the start of sheet feeding) and the timing at which sheet feeding is effected (steps S14, S15, S16 and S17).

FIG. 10 is a flowchart in the case of an operating mode in which the fixing temperature is Tb. In conformity with the above-mentioned temperature difference the electrical energization starting timing is changed over to one of the timing at which sheet feeding is effected and the timing at which the fed paper sheet passes the registration rollers (steps S24, S25, S26 and S27).

FIG. 11 is a flowchart in the case of an operating mode in which the fixing temperature is Tc (a high mode). In conformity with the above-mentioned temperature difference, the electrical energization starting timing is changed over to one of the timing at which sheet feeding is effected and the timing at which the transfer bias voltage is rendered ON (steps S34, S35, S36 and S37). When the fixing temperature T3 is high (Tc) and the above-mentioned temperature difference is small, the heater is turned on latest (S37).

By the above-described construction, when the operating mode in which the fixing temperature is Tc is selected to secure the fixing property for thick paper or the like, the heater ON timing becomes later under a predetermined condition than when the operating modes in which the fixing temperatures are Ta and Tb are selected. Consequently, even when other paper than thick paper has been printed without the operating mode being changed over after thick paper has been printed in the operating mode in which the heater temperature is high, the pressure roller is not excessively warmed and the amount of steam created from the paper sheet at the fixing nip is suppressed, and it becomes possible to prevent the slip and stabilize the conveyance of the fixed paper sheet. Also, the process of FIG. 11 of the present embodiment is carried out after the pressure roller has been warmed and therefore, it is possible to raise the heater temperature sufficiently by the time when the paper sheet arrives at the fixing nip, and a sufficient fixing property can also be secured for thick paper.

Experiment 2

In the printer used in the first embodiment (Embodiment 1), the heater ON timing was changed in the following three ways and the intermittent printing of 100 sheets each for standby early in the morning was effected under the following conditions:

Heater ON timing changeover: set to Tc−T3≦A=50(° C.)

set to Tb−T2≦B=70(° C.)

set to Ta−T1≦B=80(° C.)

Result: the slip did not occur at the pressure roller temperature of 140° C. or lower.

(Office reader A4 of 64 g/m$^2$ having a moisture content of 8.5% and left at 23° C./70%)

Bad fixing did not occur at each temperature.

(105 g/m$^2$ bond Ltr left as it was)

Figure 12:
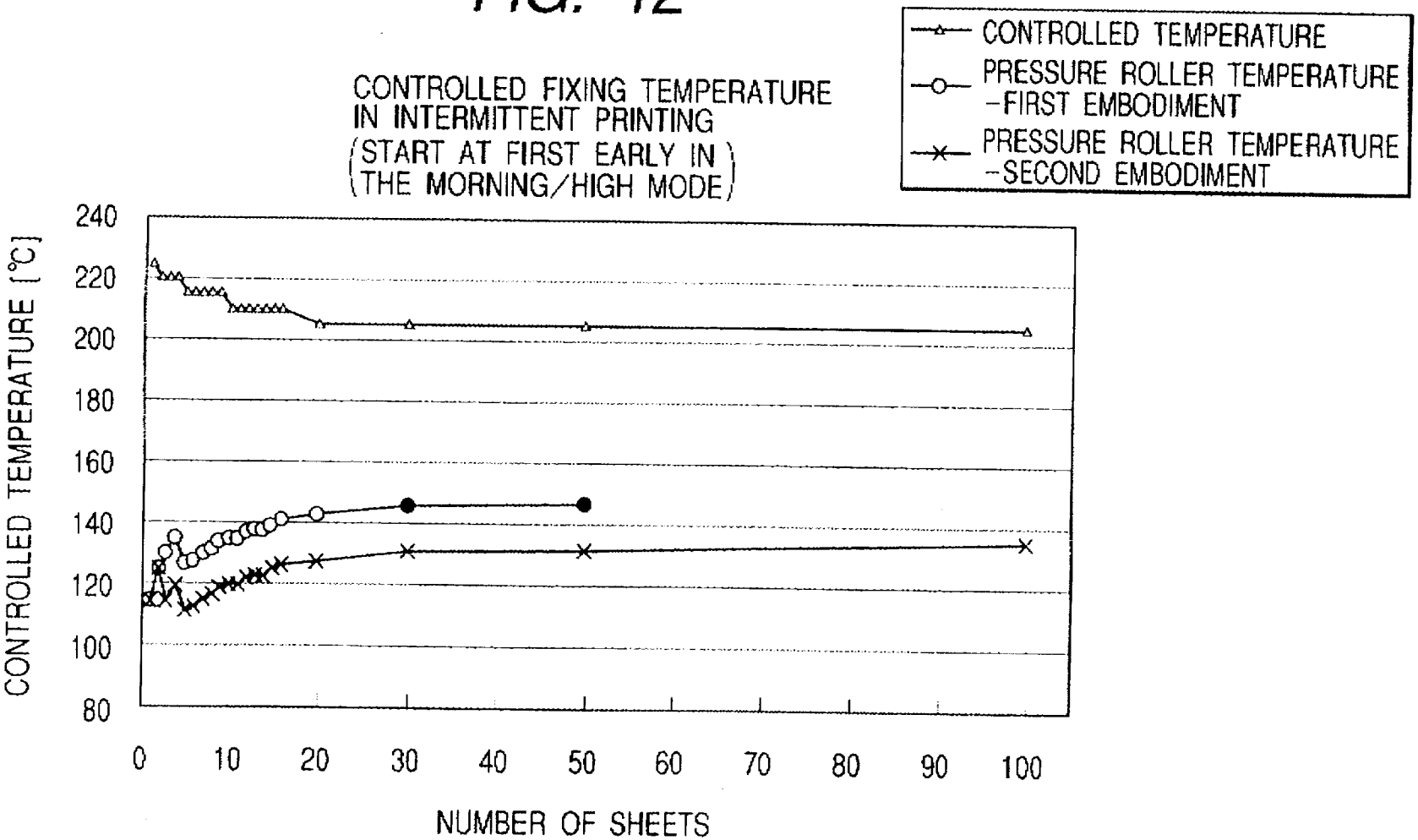
FIG. 12 is a graph showing the result of Experiment 2.

FIG. 12 shows the data of the comparison with Embodiment 1. It will be seen that by changing the changeover temperature, the changeover mode is entered earlier by two sheets and even in the printing thereafter, the temperature rise of the pressure roller is suppressed.

Third Embodiment

When in the construction of the aforedescribed second embodiment (Embodiment 2), under the temperature control of the high mode Tc, 105 g/m$^2$ bond paper left under an environment of 12° C./10% was printed, bad fixing occurred for the third to fifth sheets early in the morning. This is because under an environment of 12° C./10%, the control of Embodiment 2 enters, whereby the temperature of the pressure roller falls and a sufficient fixing temperature is not obtained. Also, the interior of the printer is immediately warmed by the start of the operation, but dry paper sheets left outside the apparatus are sufficiently cold and therefore, when the control of Embodiment 2 enters initially, a sufficient fixing temperature is not obtained and bad fixing occurs.

The present embodiment (Embodiment 3) will be described hereinafter. In the image forming apparatus of Embodiment 1 (FIGS. 1 and 4A), a thermistor 26 for detecting the atmospheric temperature is additionally disposed. It is to be understood that the temperature control of the present embodiment is such that when the atmospheric temperature information detected by the thermistor 26 is Tα, Tβ and Tγ (Tα<Tβ<Tγ), the heater ON timing is made later in the order of Tα, Tβ and Tγ.

That is, Tα can be judged as a low-temperature environment, Tβ can be judged as an ordinary environment, and Tγ can be judged as a high-temperature environment, and the amount of steam created from the paper sheet at the fixing nip is greater in the order of Tα, Tβ and Tγ. So, by making the heater ON timing later in the order of Tα, Tγ and Tγ, the pressure roller is not excessively warmed in each environment, and it is possible to suppress the amount of created steam and prevent the slip. In addition, in the low-temperature environment, the paper sheets are cold and therefore, the quantity of heat required for fixing becomes great and the fixing temperature becomes high, whereby much time is taken for raising, but since the heater is raised early, the raising time is sufficient and the fixing property can be secured. Further, by combining the present embodiment with Embodiment 2, it becomes possible to obtain the optimum heater temperature control in conformity with the environment of use of the printer, and irrespective of the environment, the sheet type and the situation in which paper sheets are left, good fixed images can be obtained and it becomes possible to prevent the slip and stabilize the conveyance of the fixed paper sheet.

While in the present embodiment, control is effected by only the atmospheric temperature information, control can also be effected by humidity control and both of them (environmental information).

Fourth Embodiment

This embodiment has features in the target temperature control and electrical energization timing control of the fixing device during the initial rotation operation. The construction, etc. of the image forming apparatus are similar to those in the first to third embodiments.

Figure 15:
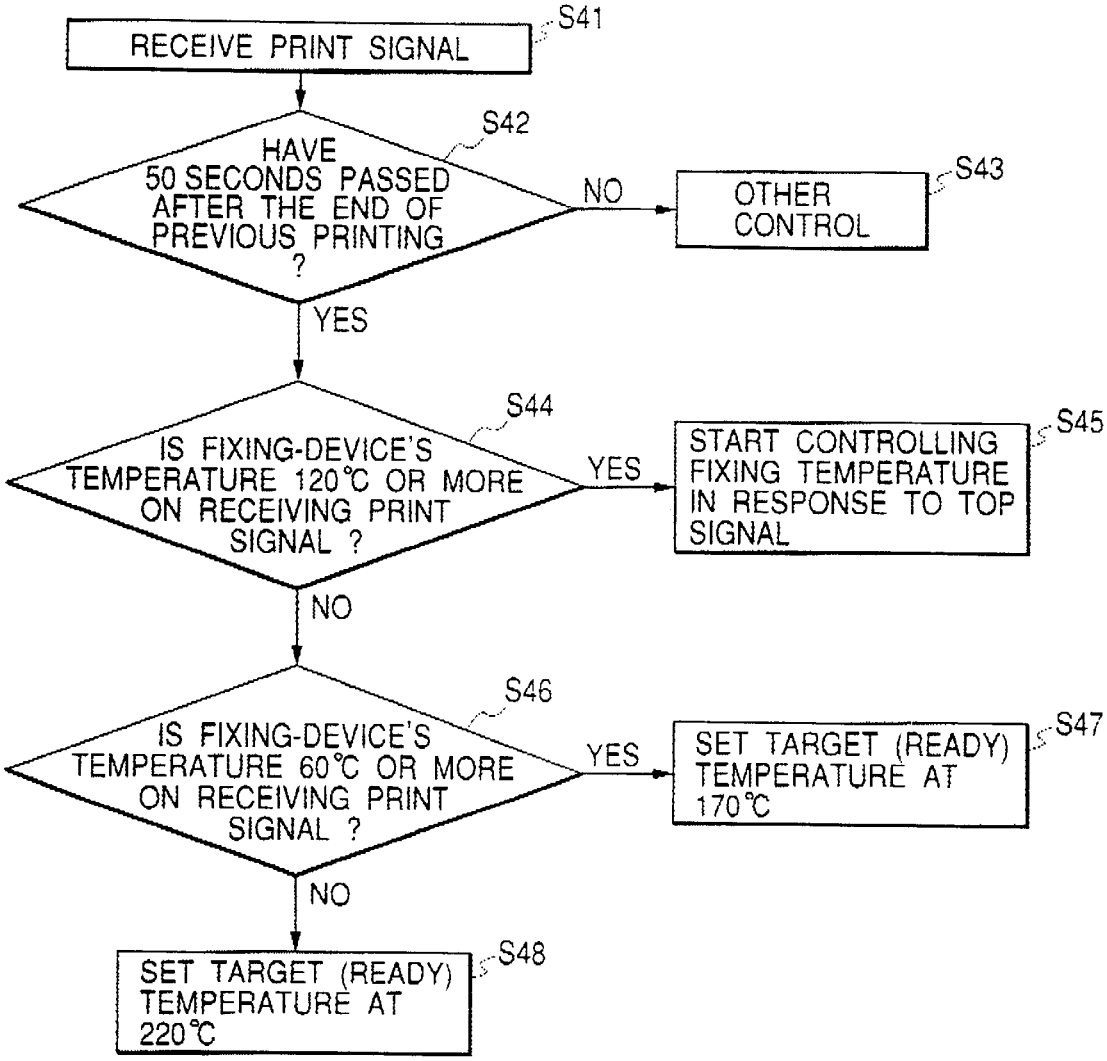
FIG. 15 is a control flowchart.

FIG. 15 is a control flowchart of the target temperature control and electrical energization timing control of the fixing device by the control system during the initial rotation operation in the present embodiment.

As previously described, when the image forming apparatus (printer) receives a print signal, the initial rotation operation which is the preparatory stage before the printing operation starts.

At this time, the electrical energization of the heater 54 of the fixing device 2 is started to thereby raise the fixing device 2. In the present embodiment, it is to be understood that the temperature of the fixing device 2 is the temperature of the heater 54 detected by a chip thermistor 54*e*. In the present embodiment, in a state in which the fixing device 2 is cold to the room temperature, the fixing device 2 is raised to the target temperature (hereinafter referred to as the ready temperature) of 220° C. during the initial rotation operation in a raising time of about 5 seconds, and the aforedescribed image forming preparatory operations are performed so as to accord with this timing. When the preparation is completed and a ready state is brought about, a paper sheet P is conveyed and in conformity with a top signal, a toner image formed on the photosensitive drum 3 is transferred to the paper sheet P.

The paper sheet P bearing the unfixed toner image T thereon is conveyed to the fixing device 2. During the time when the paper sheet P is conveyed to the fixing nip portion n, the fixing device 2 falls in temperature to the print fixing controlled temperature of 190° C. and the fixing operation is performed.

The reason why during the raising of the fixing device, the ready temperature is set to a temperature higher than the fixing temperature is for more warming the pressure roller 52 within a limited time. The temperature of the pressure roller can be made higher if the raising time is extended, but the extended raising time will spoil the on-demand property and therefore is not suitable.

The unfixed toner image is heated and pressurized in the fixing nip portion n formed by the heating portion (film and a ceramic heater) and the pressure roller of the fixing device and is fixed on the paper sheet P, whereafter the paper sheet P is delivered out of the apparatus.

In the present embodiment, there will be shown an example in which in a state in which the fixing device 2 is warm after the completion of the printing operation, the next printing operation is performed. Table 1 below shows a method of raising the fixing device when the fixing device 2 is already warm.

TABLE 1

| fixing device temperature during print signal | heater electrical energization timing | ready tempera-ture |
|---|---|---|
| lower than 60° C. | during print signal | 220° C. |
| 60° C. to 120° C. | during print signal | 170° C. |
| 120° C. or higher | during top signal | — |

Figure 16:
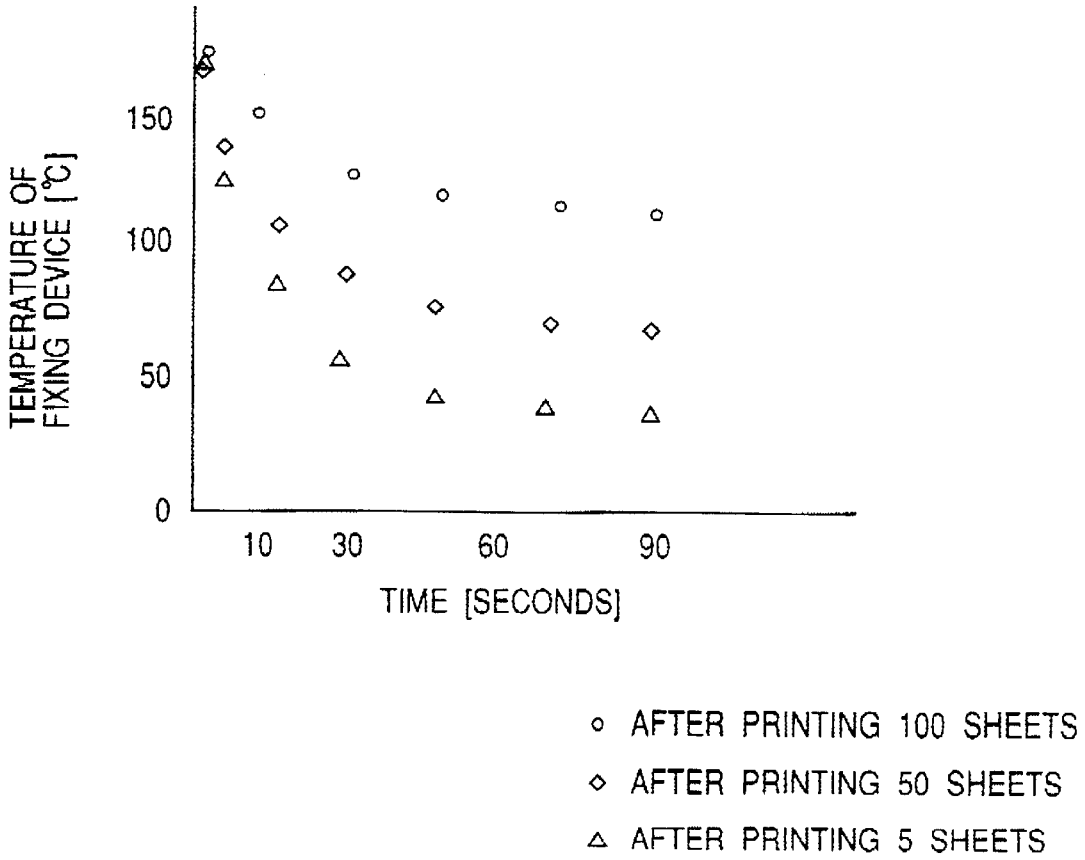
FIG. 16 is a graph of the temperature of the fixing device.

The fixing device temperature during the print signal in Table 1 is the temperature of the heater 54 detected by the chip thermistor 54*e* of the fixing device 2 when the image forming apparatus has received the print signal (S41). However, by the present invention, it is a condition that 50 seconds or longer has elapsed after the termination of the preceding printing operation (S42). If the time elapsed is within 50 seconds, the temperature control setting in the preceding printing operation is continuedly used (S43). The value of 50 seconds is a time necessary for the fixing device temperature to become approximately stable. FIG. 16 is a graph in which changes, in the temperature detected by the chip thermistor 54*e* of the fixing device 2 after 5 sheets, 50 sheets and 100 sheets have been printed are plotted.

When 5 sheets have so far been printed, the fixing device is not sufficiently warmed and therefore the temperature fall is sudden. But after the lapse of 50 seconds or so, the temperature becomes approximately stable. When 50 sheets have been printed, the fixing device becomes warm to some extent and the temperature fall is gentle. When 100 sheets have been printed, the fixing device becomes considerably hot and therefore keeps a high temperature even after the temperature has become stable. In any case, if the temperature of the fixing device is monitored at a point of time whereat 50 seconds or longer has elapsed, the temperature error may be small. Conversely, when the next print has come within 50 seconds after the printing, even if the thermistor temperature of the fixing device is detected, temperature differs depending on time and therefore, how hot the fixing device is cannot be known. Accordingly, within a predetermined time (in the present embodiment, 50 seconds), it is preferable to control with the previous controlled temperature continued.

The heater electrical energization timing is the timing for electrically energizing the heater to raise the fixing device. The ready temperature is the target temperature of the fixing device at the preparatory stage of fixing.

The case where the temperature of the fixing device when the print signal has come is lower than 60° C. (S46) is a case where the fixing is cold and therefore, the heater electrical energization timing is set to a point of time at which the print signal has come, and the ready temperature is set to a high temperature of 220° C. (S48).

The case where the temperature of the fixing device when the print signal has come is higher than 60° C. and lower than 120° C. is a case where the fixing device is warmed to some extent (S46), and the heater electrical energization timing is set to a point of time at which the print signal has come, and the ready temperature is set to a low temperature of 170° C. (S47).

The case of 120° C. or higher (S44) is a case where the fixing device is very hot, and the heater electrical energization timing is a point of time at which the top signal has come, and there is not the ready target temperature because the heater is not electrically energized hitherto. The fixing device is heated after the top signal has come out and therefore, it is controlled to the controlled temperature during printing. In this case, the fixing device is hot and therefore, it is in time for the fixing operation even if the electrical energization of the heater is started after the top signal has come out.

Table 2 below shows the raising operation when in the present embodiment, in 50 seconds after the printing of 10 sheets, 50 sheets and 100 sheets, the next printing operation is performed.

TABLE 2

| number of printed sheets at last time | fixing device temperature during print signal | heater electrical energization timing | ready tempera-ture | fixing prop-erty/ hot offset | fixing slip |
|---|---|---|---|---|---|
| 10 sheets | 45° C. | during print signal | 220° C. | no problem | not occurred |
| 50 sheets | 76° C. | during print signal | 170° C. | no problem | not occurred |
| 100 sheets | 135° C. | during top signal | — | no problem | not occurred |

As shown above, no problem arose in any cases after the printing of 10 sheets, 50 sheets and 100 sheets.

Even if the heater electrical energization starting timing is set to the arrival of the top signal, the pressure roller 52 does not rise in temperature because the heater 54 is not electrically energized until the top signal comes out. This is effective to prevent the excessive temperature rise of the pressure roller 52 when the fixing device is hot.

On the other hand, Table 3 below shows the raising operation when the next printing operation is performed in 50 seconds after the printing of 10 sheets, 50 sheets and 100 sheets in the comparative example of the conventional art.

TABLE 3

| number of printed sheets at last time | fixing device temperature during print signal | heater electrical energization timing | ready temperature | fixing property/ hot offset | fixing slip |
|---|---|---|---|---|---|
| 10 sheets | 45° C. | during print signal | 170° C. | no problem | not occurred |
| 50 sheets | 76° C. | during print signal | 170° C. | no problem | not occurred |
| 100 sheets | 135° C. | during print signal | 170° C. | hot offset occurred | occurred |

In the comparative example of the conventional art, irrespective of the temperature of the fixing device, the heater electrical energization starting timing is the arrival of the print signal and the ready temperature is 170° C. and therefore, offset occurred to the image after 100 sheets were printed.

Also, in the case of moisture-absorbing paper sheets after the lapse of a day or longer after unsealing, there arose the problem that jam occurs due to the paper sheets slipping in the fixing device and being not conveyed.

Besides, regarding the contamination of the pressure roller by the toner in such a mode that the frequency of printing is as low as e.g. one sheet printed per 10 minutes, Table 4 below compares and shows the results of paper sheets containing calcium carbonate having been supplied.

TABLE 4

| | fixing device temperature during print signal | heater electrical energization timing | ready temperature | contamination of pressure roller |
|---|---|---|---|---|
| present embodiment | 32° C. | during print signal | 220° C. | no problem |
| comparative example of conventional art | 29° C. | during print signal | 170° C. | contamination occurred |

According to Table 4, in the present embodiment, the ready temperature was 220° C. and the pressure roller could be kept at a high temperature, and even for the printing of 20,000 sheets, the contamination of the pressure roller did not occur, while in the comparative example of the conventional art, the adherence of the toner onto the pressure roller was seen for the printing of 5,000 sheets. This adherence of the toner onto the pressure roller will before long appear as the stains by toner dregs on printed paper sheets and will pose the problem of bad images.

Comparing the temperatures of the pressure roller immediately before the paper sheet enters the fixing device, in the present embodiment, the temperature was 119° C., whereas in the comparative example of the conventional art, the temperature was 91° C. This temperature difference is considered to have become the difference in the adherence of stains onto the pressure roller.

As described above, in the present embodiment, in the printing in the warm state of the fixing device after the termination of any printing operation, the target temperature (ready temperature) and the heater electrical energization timing are changed in conformity with the heater temperature after the lapse of a predetermined time, whereby appropriate temperature control can be effected even in the warm state of the fixing device after the termination of any printing operation, and hot offset and the slip of the fixing device can be prevented.

Fifth Embodiment

This embodiment is characterized in that an atmospheric temperature detecting sensor (atmospheric temperature sensor) is provided in the image forming apparatus and both of the detected temperature thereby and the temperature of the fixing device are utilized to determine the fixing controlled temperature. The construction, etc. of the image forming apparatus are similar to those in the first to fourth embodiments.

Referring to FIG. 1, the reference numeral 26 designates a thermistor for the detection of the atmospheric temperature used in the present embodiment. The mounted position of this thermistor 26 is set so as to measure the atmospheric temperature accurately and not to be affected by the temperature rise in the interior of the image forming apparatus (printer). Specifically, it is preferable to install the thermistor 26 near a vent hole in a sheathing apt to touch the atmosphere or near an atmosphere intake in the air course of the main body.

In the present embodiment, there will be shown examples in which when the atmospheric temperature is high, normal and low, the next printing operation is performed after the termination of a printing operation. Table 5 below shows a method of raising the fixing device when the fixing device is already warmed after the printing operation.

TABLE 5

| atmospheric temperature | temperature of fixing device during print signal | heater electrical energization timing | ready temperature |
|---|---|---|---|
| lower than 170° C. | lower than 60° C. | during print signal | 220° C. |
| | 60° C. to 120° C. | during print signal | 220° C. |
| | 120° C. or higher | during print signal | 170° C. |
| 17° C. or higher and lower than 30° C. | lower than 60° C. | during print signal | 220° C. |
| | 60° C. to 120° C. | during print signal | 170° C. |
| | 120° C. or higher | during top signal | — |
| 30° C. or higher | lower than 60° C. | during print signal | 170° C. |
| | 60° C. to 100° C. | during print signal | 170° C. |
| | 100° C. or higher | during top signal | — |

The temperature of the fixing device during the print signal in Table 5 is the temperature of the heater 54 detected by the chip thermistor 54*e* of the fixing device 2 when the image forming apparatus has received the print signal. Again in the present embodiment, however, it is a condition that 50 seconds or longer has elapsed after the termination of the preceding printing. In the case of within 50 seconds, the preceding controlled temperature is intactly taken over and temperature control is effected.

As shown in Table 5, in the present embodiment, the atmospheric temperature is classified into three levels, i.e., a low temperature (lower than 17° C.), a normal temperature (17° C. or higher and lower than 30° C.) and a high temperature (30° C. or higher), and the method of raising the fixing device is also changed depending on the atmospheric temperature to thereby make finer control possible.

For example, in the case of the low temperature, there are the problems of the fixing property and the contamination of the pressure roller and therefore, the heater electrical energization timing is set to the point of time at which the print signal has come, so as to heat the pressure roller, and the ready temperature is set to 220° C. for the temperature of the fixing device of up to 120° C.

In the case of the high temperature, there are the problems of hot offset and slip and therefore, the heater raising timing was set to the timing of the top signal for the temperature of the fixing device of 100° C. or higher, and the ready temperature was set to 170° C. for the temperature of the fixing device lower than 60° C.

Thereby, the image forming apparatus could be used without any problem even when the environmental temperature at which it was used was extremely low or extremely high.

Also, while in the present embodiment, the heater electrical energization starting timing was set to the point of time of the print signal or the point of time of the top signal, this is not restrictive, but it is also possible to delay the heater electrical energization, such as to start it in one second or two seconds after the print signal timing. By delaying, the time for heating the pressure roller is decreased, and this likewise leads to the effect that the excessive temperature rise of the pressure roller can be prevented.

Others

1) The construction form of the ceramic heater 54 is of course not restricted to that of the embodiments.

2) The fixing film 55 is rotated while its inner surface rubs against the heater 54 and the film guide member 53 and therefore, it is necessary to make small the frictional resistance between the heater 54 and the fixing film 55 and between the film guide member 53 and the fixing film 55. For this purpose, a small amount of lubricant such as heat-resistant grease is disposed on the surfaces of the heater 54 and the film guide member 53. Thereby it becomes possible for the fixing film 55 to be smoothly rotated.

The film 55 can be made into the shape of a rolled web, which can also be designed to be moved by the rotative driving of the pressure roller 52.

Also, while in the embodiments, the film type fixing device is of a pressure rotary member driving type, it may be a film type fixing device of a type in which a drive roller is provided on the inner peripheral surface of endless fixing film and the film is driven while tension is applied thereto, or a film type fixing device of a type in which the film is made into the shape of a rolled web, which is driven to move.

3) Also, the fixing device may be of an electromagnetic induction heating type using an electromagnetic induction heat generating member such as an iron plate as the heater.

Figure 13:
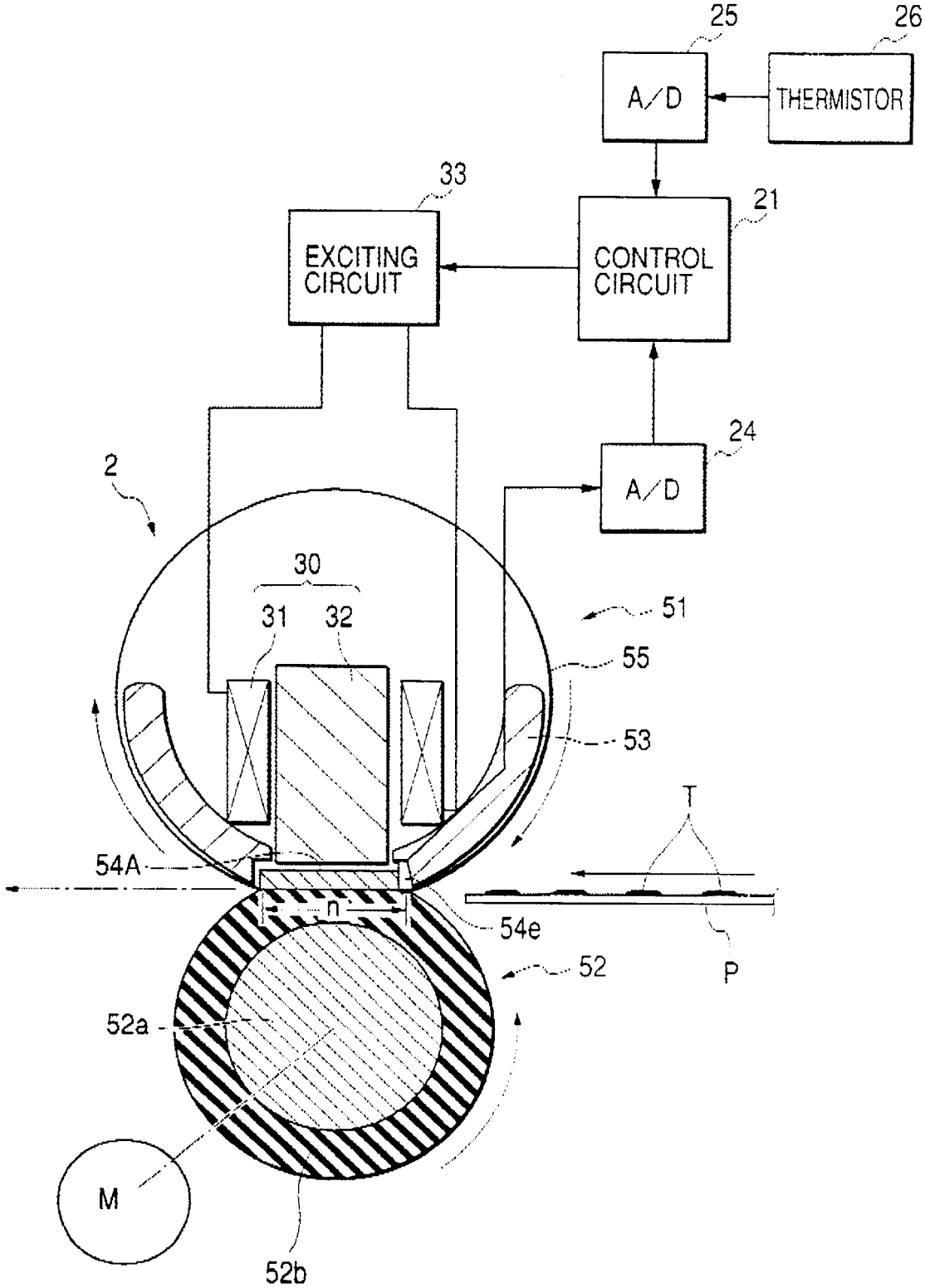
FIG. 13 schematically shows the construction of an example of a fixing device of the electromagnetic induction heating type.
Figure 14:
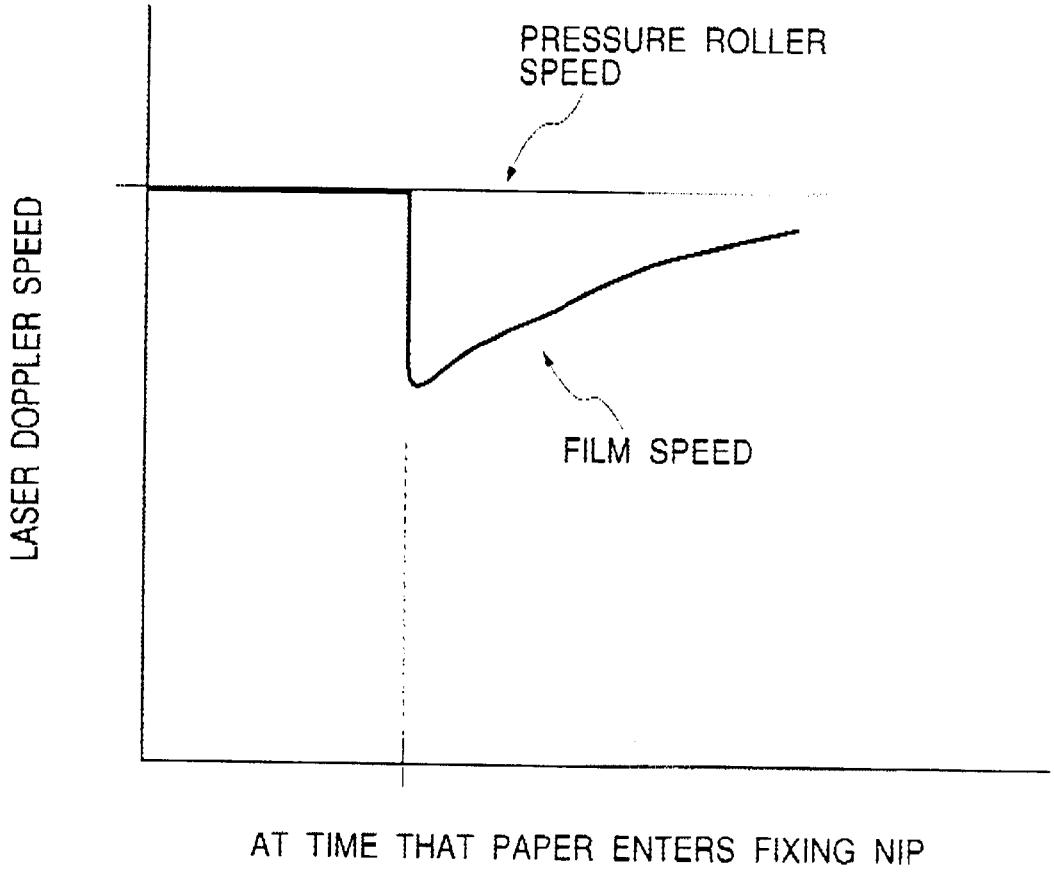
FIG. 14 shows the result of Doppler speed measurement.

FIG. 13 is a model view schematically showing the construction of an electromagnetic induction heating type, pressure rotary member driving type, film type on-demand fixing device. The reference sign 54A designates an electromagnetic induction heat generating member such as an iron plate as a heater. The reference numeral 30 denotes a magnetic field generator comprising an excitation coil 31 and a magnetic core 32. The heater 54A generates electromagnetic induction heat by a high frequency magnetic field generated by a high frequency current being supplied from an excitation circuit 33 to the excitation coil 31. A paper sheet (recording material) P nipped and conveyed by a fixing nip portion n is heated by the heat of the heater 54A. The temperature information of the heater 54A is introduced from a chip thermistor 54*e* into a control circuit 21 through an A/D converter 24. The control circuit 21 controls the excitation circuit 33 to control the temperature of the heater 54A to a predetermined constant temperature on the basis of the input temperature information. That is, design is made such that by controlling the high frequency current to the excitation coil 31 for causing the heater 54A to generate electromagnetic induction heat, the temperature of the heater is controlled to a target temperature (printing temperature).

The other constructions, control, etc. of the fixing device are similar to those in the first to fifth embodiments.

The present invention can also be suitably carried out for such a fixing device. Also, the first to fifth embodiments can be arbitrarily combined and carried out.

While the invention has been described with reference to the structure disclosed herein, it is not confined to the details set forth and this application is intended to cover such modifications or changes as may come within the purposes of the improvements or the scope of the following claims.

What is claimed is:

1. A fixing device comprising:

a heater;

a temperature detecting element for detecting a temperature of said heater; and temperature controlling means for controlling an electrical energization of said heater so that a detected temperature by said temperature detecting element may become a target temperature, wherein said temperature controlling means, when starting the electrical energization of said heater to fix an unfixed image formed on a recording material, starts the electrical energization of said heater at timing determined on the basis of the detected temperature by said temperature detecting element before the electrical energization of said heater is started.

2. A fixing device according to claim 1, further comprising a film for sliding relative to said heater, and a pressure rotary member brought into pressure contact with said heater through said film to thereby form a fixing nip, said pressure rotary member being driven to rotate, and wherein the recording material having the unfixed image formed thereon is nipped and conveyed between the film and the pressure rotary member in said fixing nip and the unfixed image is fixed by the heat of the heater.

3. A fixing device according to claim 1, wherein a heating starting timing of the heater is changed over a plurality of times in conformity with the temperature difference between the detected temperature by said temperature detecting element and the target temperature of the heater.

4. A fixing device according to claim 1, further comprising an atmospheric temperature detecting element, and wherein the electrical energization starting timing and target temperature of the heater are controlled on the basis of a detected temperature by said atmospheric temperature detecting element and the detected temperature by said temperature detecting element.

5. A fixing device according to claim 1, further comprising means for determining, when a next printing is to be effected after a lapse of a predetermined time after a termination of a printing operation, the target temperature of the fixing device during an initial rotation operation in the printing operation on the basis of the detected temperature by said temperature detecting element before the electrical energization of said heater is started.

6. A fixing device according to claim 5, further comprising an atmospheric temperature sensor for detecting a temperature of an atmosphere around an image forming apparatus, and wherein when the next printing is to be effected after the lapse of the predetermined time after the termination of a printing operation, the target temperature and heater electrical energization timing of the fixing device during the initial rotation operation in the printing operation are changed in conformity with the atmospheric temperature detected by said atmospheric temperature sensor and the temperature of the fixing device.

7. A temperature controlling method in a fixing device comprising a heater, a temperature detecting element for detecting a temperature of said heater, and temperature controlling means for controlling an electrical energization of said heater so that a detected temperature by said temperature detecting element may become a target temperature, said method comprising:

determining the electrical energization timing of said heater on the basis of the detected temperature by said temperature detecting element before the electrical energization of said heater is started when an unfixed image formed on a recording material, is to be fixed; and starting the electrical energization of the heater at a timing determined by the determining step.

8. A temperature controlling method according to claim 7, wherein said fixing device further comprises a film for sliding relative to said heater, and a pressure rotary member brought into pressure contact with said heater through said film to thereby form a fixing nip, said pressure rotary member being driven to rotate, and the recording material having the unfixed image formed thereon is nipped and conveyed between the film and the pressure rotary member in said fixing nip and the unfixed image is fixed by the heat of the heater.

9. A temperature controlling method according to claim 7, wherein a heating starting timing of said heater is changed over a plurality of times in conformity with a temperature difference between the detected temperature by said temperature detecting element and the target temperature of the heater.

10. A temperature controlling method according to claim 7, wherein said fixing device further comprises an atmospheric temperature detecting element, and the electrical energization starting timing and target temperature of said heater are controlled on the basis of a detected temperature by said atmospheric temperature detecting element and the detected temperature by said temperature detecting element.

11. A temperature controlling method according to claim 7, further comprising determining the target temperature of the fixing device during an initial rotation operation in a printing operation on the basis of the detected temperature by said temperature detecting element before the electrical energization of said heater is started when a next printing is to be effected after a lapse of a predetermined time after a termination of the printing operation.

12. A temperature controlling method according to claim 11, wherein said fixing device further comprises an atmospheric temperature sensor for detecting a temperature of an atmosphere, around an image forming apparatus, and when the next printing is to be effected after the lapse of the predetermined time after the termination of the printing operation, the target temperature and heater electrical energization timing of the fixing device during the initial rotation operation in the printing operation are changed in conformity with the atmospheric temperature detected by said atmospheric temperature sensor and the temperature of the fixing device.

13. An image forming apparatus comprising:

image forming process means for forming an unfixed image on a recording material; and fixing means provided with a heater, a temperature detecting element for detecting a temperature of said heater, and temperature controlling means for controlling an electrical energization of said heater so that a detected temperature by said temperature detecting element may become a target temperature, wherein when the electrical energization of said heater is to be started at predetermined timing with respect to the recording material to fix the unfixed image formed on the fed recording material, said temperature controlling means starts the electrical energization of said heater at timing determined on the basis of the detected temperature by said temperature detecting element before the electrical energization of said heater is started.

14. An image forming apparatus according to claim 13, further comprising a film for sliding relative to said heater, and a pressure rotary member brought into pressure contact with said heater through said film to thereby form a fixing nip, said pressure rotary member being driven to rotate, wherein the recording material having the unfixed image formed thereon is nipped and conveyed between the film and the pressure rotary member in said fixing nip and the unfixed image is fixed by the heat of said heater.

15. An image forming apparatus according to claim 13, wherein the heating starting timing of the heater is changed over a plurality of times in conformity with a temperature difference between the detected temperature by said temperature detecting element and the target temperature of said heater.

16. An image forming apparatus according to claim 13, further comprising an atmospheric temperature detecting element, wherein the electrical energization starting timing and target temperature of said heater are controlled on the basis of the detected temperature by said atmospheric temperature detecting element and the detected temperature by said temperature detecting element.

17. An image forming apparatus according to claim 13, having: as the target temperature of the detected temperature by said temperature detecting element, a first target temperature set during a printing operation; and a second target temperature set prior to the setting of said first target temperature, and further comprising means for determining said second target temperature on the basis of the detected temperature by said temperature detecting element.

18. An image forming apparatus according to claim 17, further comprising an atmospheric temperature sensor for detecting a temperature of an atmosphere around the image forming apparatus, wherein when a next printing is to be effected after a lapse of a predetermined time after a termination of a printing operation, said second target temperature and the heater electrical energization timing are determined on the basis of the atmospheric temperature detected by said atmospheric temperature sensor and the detected temperature by said temperature detecting element.

19. An image forming apparatus according to claim 17, wherein the second target temperature is set during an initial rotation operation in the printing operation.

20. An image forming apparatus according to claim 13, wherein said image forming process means is transfer type electrophotographic process means.

* * * * *

UNITED STATES PATENT AND TRADEMARK OFFICE

CERTIFICATE OF CORRECTION

PATENT NO. : 6,701,102 B2
DATED : March 2, 2004
INVENTOR(S) : Hiroto Hasegawa et al.

It is certified that error appears in the above-identified patent and that said Letters Patent is hereby corrected as shown below:

Title page,
Item [57], ABSTRACT,
Line 21, “printing,” should read -- printing --.

Column 1,
Line 41, “is a” should read -- is --.

Column 2,
Line 3, “same,” should read -- same time --.
Line 63, “time” should read -- the time --.

Column 4,
Line 62, “thee” should read -- the --.

Column 6,
Line 21, “beater” should read -- heater --.

Column 8,
Line 14, “cane” should read -- can be --.
Line 44, “predetermine” should read -- predetermined --.

Column 9,
Line 67, “is exposes” should read -- exposes --.

Column 10,
Line 35, “pressurized be” should read -- pressurized by --

Column 11,
Line 9, “tho recording” should read -- the recording --.

Column 12,
Line 4, “hold” should read -- held --.
Line 5, “all” should read -- an --,
Line 32, “inclose” should read -- in close --.
Line 38, “ploys” should read -- plays --.

Column 13,
Line 19, “view” should read -- view of --.

UNITED STATES PATENT AND TRADEMARK OFFICE

CERTIFICATE OF CORRECTION

PATENT NO. : 6,701,102 B2
DATED : March 2, 2004
INVENTOR(S) : Hiroto Hasegawa et al.

It is certified that error appears in the above-identified patent and that said Letters Patent is hereby corrected as shown below:

Column 16,
Line 10, “every” should read -- even --.
Line 27, “slap” should read -- slip --.
Line 37, “beat” should read -- heat --.

Column 17,
Line 47, “when” should be deleted.

Column 18,
Line 33, “Tγ” should read -- Tβ --.

Signed and Sealed this

Sixth Day of July, 2004

JON W. DUDAS
*Acting Director of the United States Patent and Trademark Office*